US006799003B2

(12) United States Patent
Kishimoto et al.

(10) Patent No.: US 6,799,003 B2
(45) Date of Patent: Sep. 28, 2004

(54) FIXING DEVICE, METHOD FOR TEMPERATURE CONTROL OF THE SAME, AND METHOD FOR MANUFACTURING ROLLERS OF THE SAME

(75) Inventors: Mitsuru Kishimoto, Tokyo (JP); Tsutomu Yamane, Tokyo (JP); Masahiko Shimosugi, Tokyo (JP); Shigeru Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/114,981

(22) Filed: Apr. 4, 2002

(65) Prior Publication Data

US 2002/0146255 A1 Oct. 10, 2002

(30) Foreign Application Priority Data

Apr. 5, 2001 (JP) ..... 2001-106548

(51) Int. Cl.[7] ..... G03G 15/20

(52) U.S. Cl. ..... 399/69; 219/216; 399/328; 492/53

(58) Field of Search ..... 399/69, 328, 330, 399/331, 333, 67, 320, 329, 332; 219/216; 492/53, 56

(56) References Cited

U.S. PATENT DOCUMENTS 4,580,033 A * 4/1986 Sakurai ..... 219/216
5,873,020 A * 2/1999 Matsuura et al. ..... 399/329

FOREIGN PATENT DOCUMENTS

JP 10-340023 * 12/1998

* cited by examiner

*Primary Examiner*—Hoan Tran
(74) *Attorney, Agent, or Firm*—Rabin & Berdo, P.C.

(57) ABSTRACT

A fixing device capable of improving printing speed without increasingly the size of rollers, and making the surface temperature of the heating roller quickly reach a target temperature. The heating roller, which comes into contact with recording sheet having unfixed toner adhering to it, includes an elastic body of low heat conductivity and high heat resistance, and has metal foil formed tightly to the external circumferential surface thereof. This meal foil with a small heat capacity, by direct contact on its surface with the heating source, helps the surface of the heating roller quickly rise in temperature.

51 Claims, 19 Drawing Sheets

(A)

(B)

(C)

FIXING DEVICE, METHOD FOR TEMPERATURE CONTROL OF THE SAME, AND METHOD FOR MANUFACTURING ROLLERS OF THE SAME

BACKGROUND OF THE INVENTION

1. Field of the Invention

The present invention relates to a fixing device for electrophotographic recording apparatus, such as electrophotographic printers, copiers and facsimiles.

2. Related Art

The fixing device used for electrophotographic recording apparatus conventionally has a heating roller as a first roller and a pressure roller as a second roller, and causes recording paper with unfixed toner adhering to it to pass through the pressed contact portions of the rollers to thereby press and fuse toner to the recording paper.

The heating roller includes a heating source inside the mandrel (a halogen lamp for example), and the mandrel is covered with an elastic body having on its outer surface a parting agent layer formed, which is high in water and oil repellency (silicon rubber for example).

Because the elastic body is pressed with the pressure roller, a deformed portion is formed in the elastic body (hereafter the length of the deformed portion is referred to as a nip amount). Therefore, the toner is fixed to the recording paper as the paper having the unfixed toner adhering to it passes along the deformed portion of the elastic body.

To control the surface temperature of the heating roller, a temperature sensor (a thermistor for example) is so arranged as to contact the surface of the heating roller.

With conventional fixing device, there has been a problem that due to the low heat conductivity coefficient of the elastic body even when the heating source is made to generate heat, it takes time for the surface temperature of the heating roller to reach a specified temperature, so that the start-up of the device takes a long time.

On the other hand, to increase the printing speed, it is necessary only to increase the nip amount of the portion of the heating roller, against which the pressure roller is pressed, to provide a contact time sufficient to fuse and fix the unfixed toner to the recording paper. In other words, supposing the amount of deformation of the elastic body is constant, the outside diameter of the rollers needs to be increased to obtain a greater nip amount. However, as the outside diameter of the rollers is increased, the device becomes larger and the recording paper that has passed the contacted portions with pressure of the rollers is likely to wind itself around the roller. Thus, to increase a greater nip amount without increasing the roller outside diameter, it is necessary to only increase the thickness of the elastic body with low heat conductivity coefficient. Here arises a problem, however, that because heating the elastic body of a great thickness takes time, the temperature rise for startup of the device takes time.

The present invention has as its object to provide a fixing device, a method of temperature control of this device, and a method of manufacturing rollers of this device, which make it possible to increase the printing speed without increasing the roller outside diameter and which enable the surface temperature of the heating roller to reach a predetermined temperature in a short time.

SUMMARY OF THE INVENTION

To achieve the above object, according to the present invention, there is provided a fixing device for passing recording paper, which has unfixed toner adhering to it, through first and second rollers mutually pressed together, and fusing the toner under heat and pressure and fixing to the recording paper, wherein the first roller heated by a heating source comprises an elastic body provided around a mandrel and having a high heat resistance and a low heat conductivity coefficient and, a heat layer with a small heat capacity formed in tight contact with the circumferential surface of the elastic body, and a parting agent layer high in water and oil repellency formed in tight contact with the circumferential surface of the heat layer.

To achieve the same object, a method for temperature control of the fixing device according to the present invention for passing recording paper having unfixed toner adhering to it through a first and a second roller heated by heating sources, and fusing the toner under heat and pressure and fixing it to the recording paper, comprises the steps of bringing a first temperature sensor into contact with a circumferential surface of an end portion of the first roller not contacting the recording paper; bringing a plurality of second temperature sensors into contact with a circumferential surface of the center portion of the second roller contacting the recording paper and also to contact with the circumferential surface of the end portion of the second roller not contacting the recording paper; setting a predetermined temperature of the circumferential surface of the first roller to be maintained; determining a temperature difference between the circumferential surface of the center portion of and the circumferential surface of the end portion of the second roller from detected temperatures by the plurality of second temperature sensors after the recording paper has passed the first and second rollers; and obtaining a temperature of the circumferential surface at the center of the first roller from the determined temperature difference and a detected temperature by the first temperature sensor, wherein the center-portion circumferential surface temperature is lower than the predetermined temperature, electric power is supplied to the heating source to heat the first roller.

DESCRIPTION OF THE EMBODIMENTS

Figure 1:
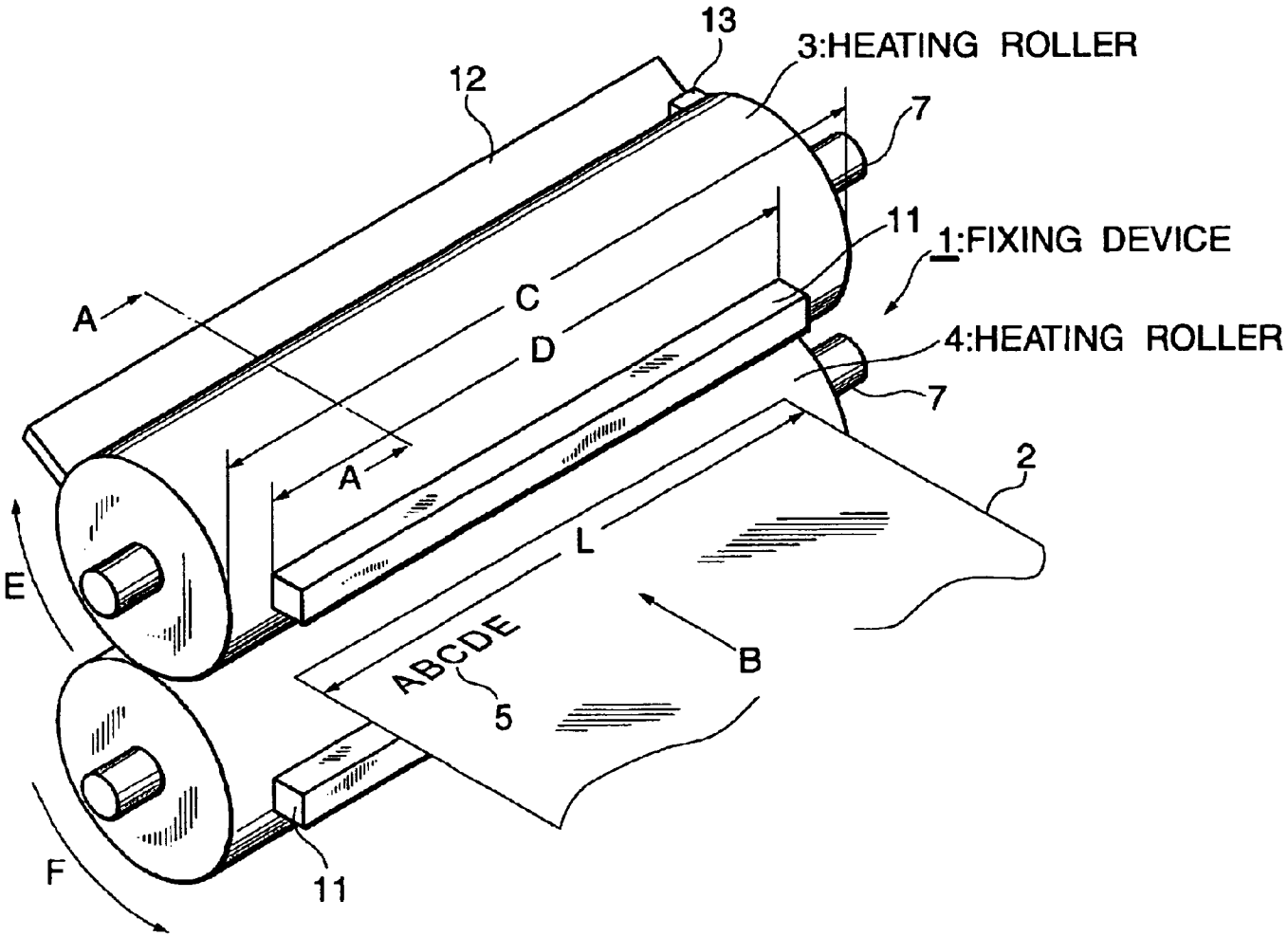
FIG. 1 is a perspective illustration of a fixing device according to a first embodiment of the present invention.

Embodiments of the present invention will be described with reference to the accompanying drawings. The common components are designated by the same symbols in the drawings.

First Embodiment

Figure 2:
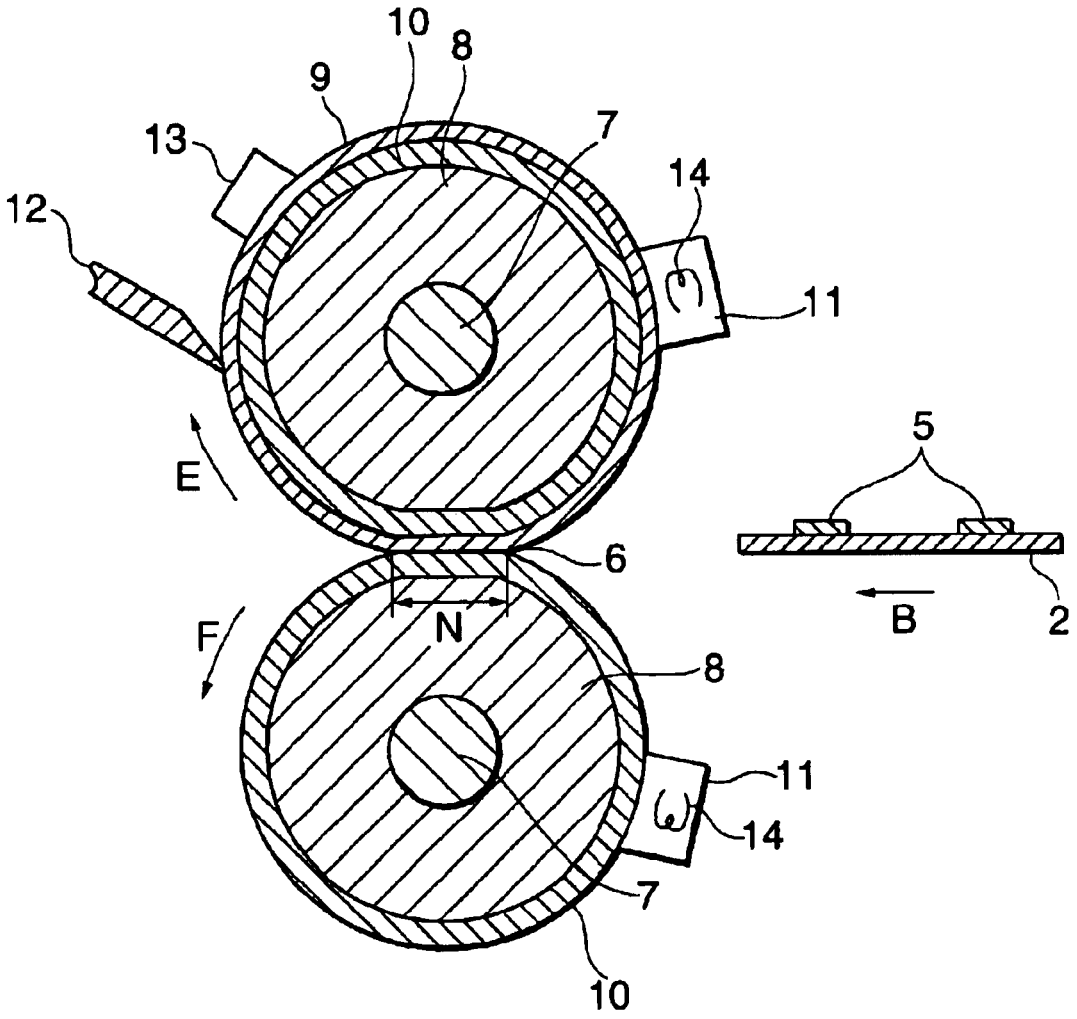
FIG. 2 is a view taken in the direction of the arrows along the line A—A of the fixing device in FIG. 1.

FIG. 1 is a perspective illustration of a fixing device according to a first embodiment of the present invention. FIG. 2 is a view taken in the direction of the arrows along the line A—A of the fixing device in FIG. 1. The fixing device 1 has a pair of heating rollers 3, 4 each with a length of C arranged along the width direction of the recording paper transferred in the direction of arrow B. The recording paper 2 having unfixed toner 5 adhering to it passes through the pressed contact portions 6 of the heating rollers 3, 4 which form the nip amount N to get the unfixed toner fused and fixed.

The heating roller 3 has a heat-resistant elastic body with a low heat conductivity formed around an outer circumference of the mandrel 7. This elastic body 8 is formed of silicon or fluoro-rubber for example. The elastic body 8 has formed attached to the surface thereof metal foil 10 as a heat layer with small heat capacity (such as nickel, stainless steel or the like with a thickness of 0.01~0.1 mm). The metal foil 10 has a length equal to the length C of the heating roller 3. Also, in place of the metal foil 10, an organic matter layer containing metal may be used.

The metal foil 10 has formed on its surface a parting agent layer 9 of fluorine based material, for example, which is high in water and oil repellency.

On the parting agent layer 9, a heating source 11 and a foreign substance-removing blade 12 are arranged in parallel with the mandrel and also in contact with the parting agent layer 9. Also, on the end portion of the parting agent layer 9(outside the maximum paper width L of recording paper), a temperature sensor 13(a thermistor for example) is arranged in contact with the parting agent layer 9 for detecting the surface temperature of the heating roller 3.

The heating roller 4 has approximately the same structure as the heating roller 3. A difference is only that the heating roller 4 does not have any parting agent layer 9 on the outer surface of the metal foil 10, and that the heating roller 4 is not provided with the foreign substance-removing blade 12 or the temperature sensor 13.

Figure 18:
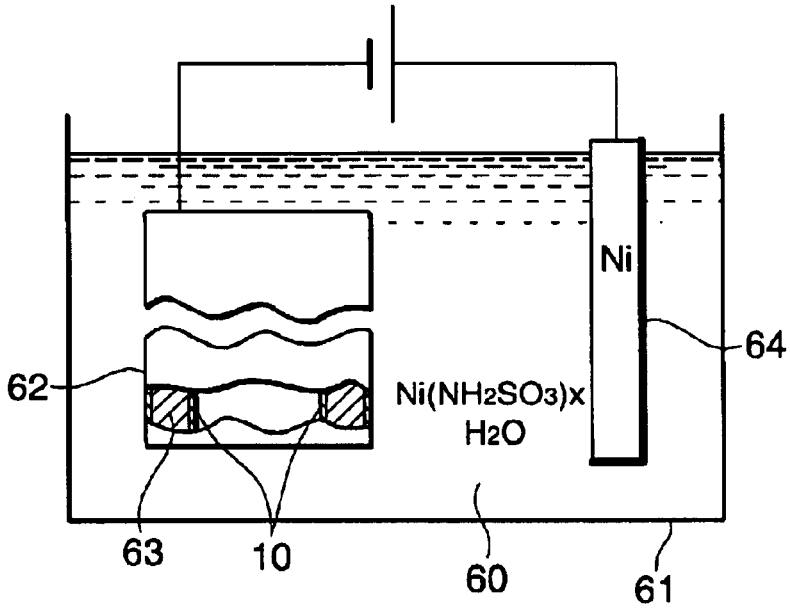
FIG. 18 is a diagram for explaining a method for manufacturing a heating roller.
Figure 18:
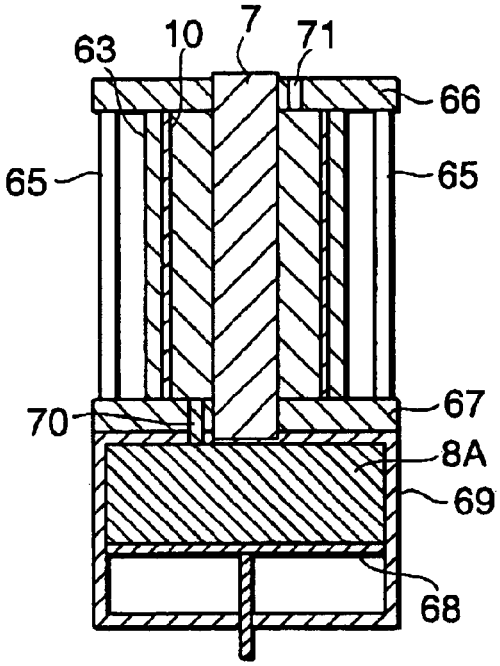
Figure 18:
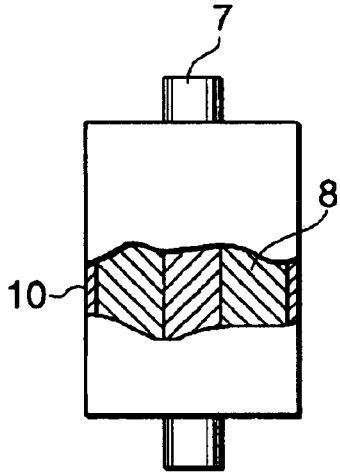

Description will be made of a method for manufacturing a heating roller. FIG. 18 is an explanatory diagram of the method for manufacturing a heating roller. As shown in FIG. 18(A), an electrolytic solution 60, such as a sulfonic acid nickel solution is contained in a vessel 61. In this solution, a cylindrical electrode 63(of stainless steel for example) having an insulating layer 62 provided on its outer circumference and an electrode 64 of nickel are arranged.

The cylindrical electrode 63 is connected to the negative pole and the electrode 64 is connected to the positive pole of power supply, and a metal foil 10 is formed by nickel metal on the internal surface of the cylindrical electrode 63 by electroplating.

Then, the cylindrical electrode 63 is extracted from the solution, and an adhesive is applied to the internal surface of the metal foil 10. Then, as shown in FIG. 18(B), the cylindrical electrode 63, the mandrel 7 and columns 65 are set between covers 66, 67 and the columns are secured with nuts, not shown. Subsequently, this assembly is mounted on and secured to a material container 69 that has a piston 68 to inject with pressure silicon 8A to form the elastic body 8. The cover 67 has an inlet port 70 and the cover 66 has an overflow port 71.

After this, the piston 68 is pushed up to inject the liquid silicon 8A through the inlet port 70 into the space inside the metal foil 10 and the silicon solidifies as it crosslinks with the adhesive. The silicon, after it is solidified, is taken out of the cylindrical electrode 63 as shown in FIG. 18(C). Thus, a heating roller 4 is formed.

Next, to form the heating roller 3, after detaching from the cylindrical electrode 63, the roller is coated on its surface with a fluorine-based material to form the parting agent layer 9.

Before the metal foil 10 is made to precipitate out on the indicates of the cylindrical electrode 63 by electroplating, fluorine powder is dispersed uniformly in the electrolytic solution 60 by using an interfacial active agent. Consequently, a composite plating foil formed of nickel metal, containing fluorine powder, precipitates on the inner surface of the cylindrical electrode 63.

By subjecting the cylindrical electrode 63 to heat treatment at about the melting temperature of fluorine or higher (for example, at treatment temperatures of 320° C.~380° C. and for a treatment time of 0.5H~1.5H), a thin film of fluorine is formed on the surface of the metal foil, so that it becomes unnecessary to perform a separate process of forming the parting agent layer 9.

Instead of electroplating, the metal foil 10 may be formed by extrusion. When extrusion is used, the parting agent layer 19 is previously formed on the outer circumference of the metal foil 10 for higher rigidity, and then liquid silicon is injected to form the roller.

Furthermore, after a roller is manufactured by forming the metal foil 10 with greater thickness, and injecting liquid silicon into the inside space, and then the outer circumference of the metal foil 10 may be ground.

Or, the silicon elastic body 8 is formed in a cylindrical form by injecting silicon to the outer circumference of the mandrel 7, and then the elastic body 8 is immersed in a palladium chloride solution to make palladium precipitate on the surface of the elastic body 8. After being rinsed with water, the elastic body 8 is immersed in a NiP solution, for example, to make nickel as a metal foil 10 on the surface of the elastic body by electroless plating. Subsequently, the metal foil 10 that precipitated out at the end portions of the roller is cut off.

When nickel is precipitated as the metal foil 10 on the surface of the elastic body 8 by electroless plating, if fluorine powder is dispersed in the NiP solution, a composite plating foil by nickel metal, containing fluorine powder, precipitates out and serves also as the parting agent layer 9.

When the elastic body 8 of a cylindrical shape is formed by injecting silicon to the outer circumference of the mandrel 7 as mentioned above, if silicon is previously added with palladium, it is not necessary to perform a palladium process to immerse the elastic body in a palladium chloride to precipitate palladium on the surface of the elastic body 8. The description of the heating roller manufacturing method is finished.

The heating source 11 is provided on the recording-paper incoming side of the pressure-contact portions 6 of the rollers. The heating source comprises a housing that has reflecting surfaces inside it and a halogen lamp 14. The length D of the heating source 11 is larger than the maximum paper width L of the recording paper 2 and smaller than the length C of the heating roller 3.

Figure 3:
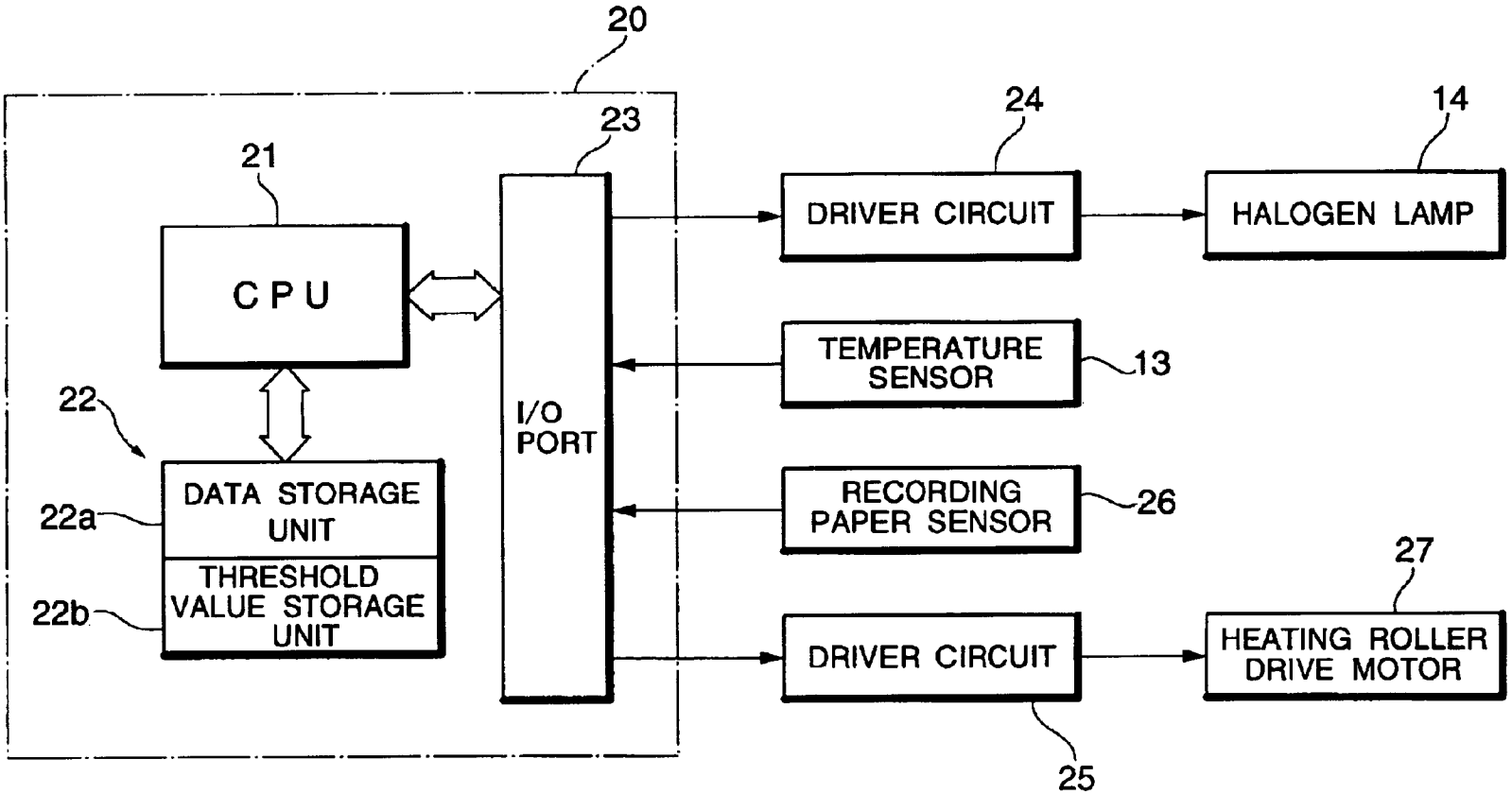
FIG. 3 is a control block diagram of the fixing device in FIG. 1.

FIG. 3 is a control block diagram of the fixing device shown in FIG. 1. The controller 20 includes a central processing unit 21 (hereafter referred to the CPU), memory 22, and an I/O port 23. The memory 22 includes a data storage unit 22*a* for storing data, and a threshold value storage unit 22*b* for storing a threshold value by which to control the surface temperature of the heating roller 3 to keep it at a predetermined temperature.

The CPU 21 is connected through the I/O port to driver circuits 24, 25, the temperature sensor 13, and a recording paper sensor 26. The driver circuits 24, 25 are respectively connected to the halogen lamps 14 and a heating roller drive motors 27.

Figure 4:
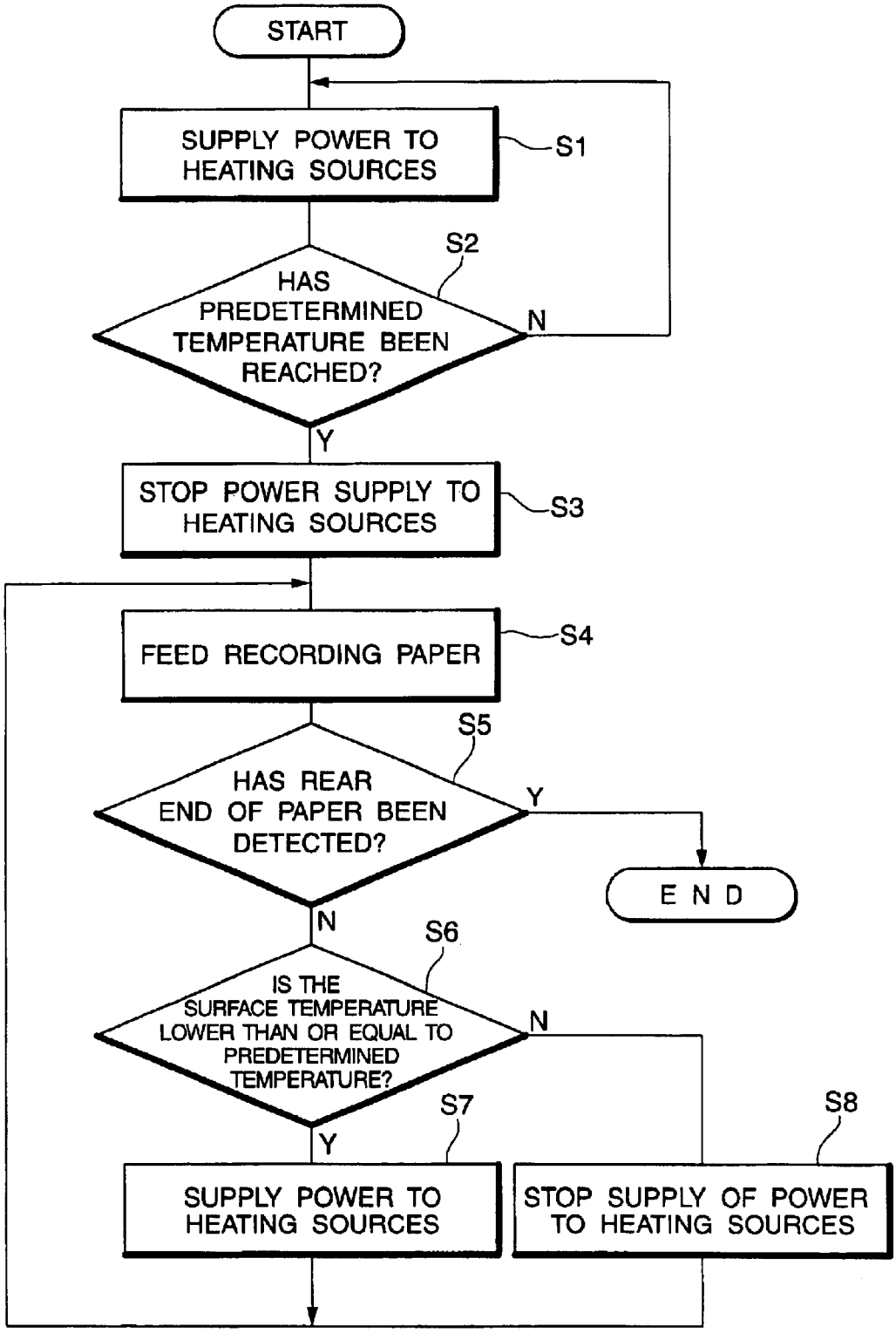
FIG. 4 is a flowchart showing the operation of the fixing device in FIG. 1.

Description will next be made of operation of the fixing device with reference to FIG. 4. FIG. 4 is a flowchart showing the operation of the fixing device. When the operator turns on the power switch, not shown, electric power is supplied to the apparatus, such as an electrophotographic printer, and at the same time the CPU 21 is reset to initialize the electrophotographic printer.

After the above initialization, at step S1, the CPU 21 supplies power through the driver circuits 24, 25 to the halogen lamps 14 and the heating roller drive motors 27, so that the heating rollers 3, 4 are rotated in the directions of arrows E and F, and the metal foil 10 is heated.

At the step S2, the CPU 21 detects the surface temperature of the heating roller 3 through the temperature sensor 13, and compares the detected temperature with a threshold value stored in the threshold value storage unit 22*b* of the memory 22. When the surface temperature of the heating roller 3 reaches the threshold value, the operation of the fixing device proceeds to a step S3, or if the decision at the step S2 is no, the process moves on to the step S1.

At the step S3, the CPU 21 stops supply of power to the halogen lamps 14, and at a step S4, lets out recording paper 2 from a cassette, not shown, to an image forming unit, not shown. A toner image formed by the image forming unit is transferred to the recording paper 2, and the recording paper having the toner image transferred thereto is sent towards the fixing device 1.

At a step S5, the CPU 21 detects the rear end of the recording paper 2 through the recording paper sensor 26, and if the decision at the step S5 is yes, the process for one piece of recording paper is finished, or if the decision is no, the operation of the fixing device moves on to a step S6.

When, at the step S6, the CPU 21 detects through the temperature sensor 13 whether the surface temperature of the heating roller 3 is lower than or equal to the predetermined temperature, if the surface temperature of the heating roller 3 is lower than or equal to the predetermined temperature, the operation of the fixing device moves on to a step S7, or if the decision at the step S6 is no, the operation of the fixing device moves on to a step S8.

At the step S7, the CPU 21 supplies power to the halogen lamps 14, and the operation proceeds to the step S4.

At the step S8, the CPU 21 stops supply of power to the halogen lamps 14, and the operation proceeds to the step S4.

Figure 5:
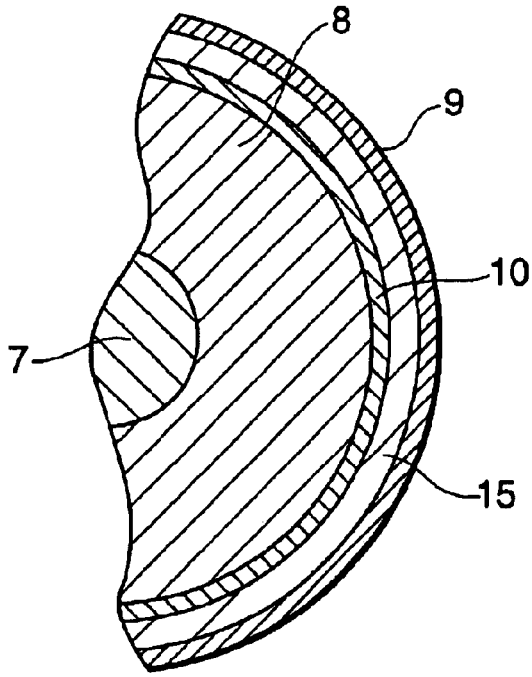
FIG. 5 is a modified embodiment (1) of the heating roller.

In this first embodiment, the metal foil 10 with small heat capacity, which has the parting agent layer 9 provided on its outer side, is formed in tight contact with the outer surface of the elastic body 8 as described above, but as shown in FIG. 5, an elastic body layer 15 with a high heat conductivity may be provided between the metal foil 10 and the parting agent layer 9. In the latter case, deformation to the metal foil 10 at the pressed contact portions 6 of the rollers can be lessened and separation of the metal foil 10 from the elastic body 8 can be prevented.

The elastic body layer 15 is formed by applying a coating of heat-resistant silicon with a high heat conductivity coefficient to the outer surface of the metal foil 10 and further applying a coating of the parting agent layer 9, and finally by baking for crosslinking reaction.

Figure 6:
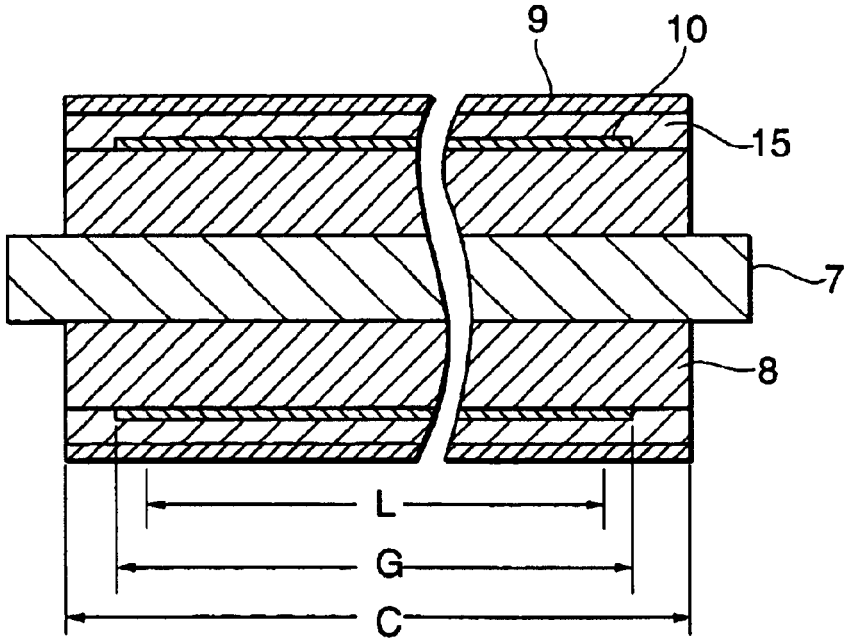
FIG. 6 is a modified embodiment (2) of the heating roller.

When the heat-resistant elastic body layer 15 with high heat conductivity coefficient is provided between the metal foil 10 and the parting agent layer 9, if the relation among the width C of the elastic body layer 15, the width G of the metal foil, and the maximum width L of fixable recording paper is C>G>L as shown in FIG. 6, the elastic body layer 15 is formed enclosing the metal foil, with both ends portions thereof tightly attached to the elastic body 8. Therefore, the adhesion and the sticking strength among the elastic body 8, the metal body 10, and the elastic body layer 15 can be improved and the separation problem of the metal foil 10 can be precluded.

Figure 7:
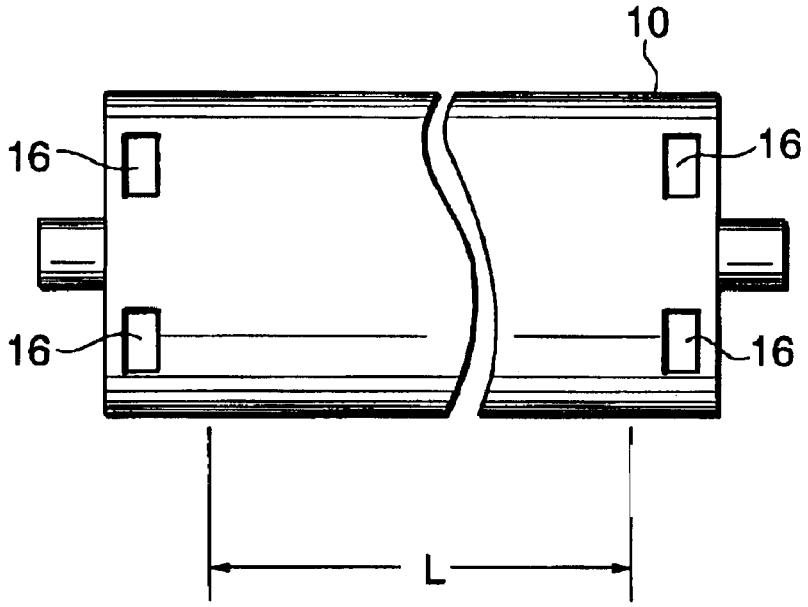
FIG. 7 is a modified embodiment (3) of the heating roller.
Figure 8:
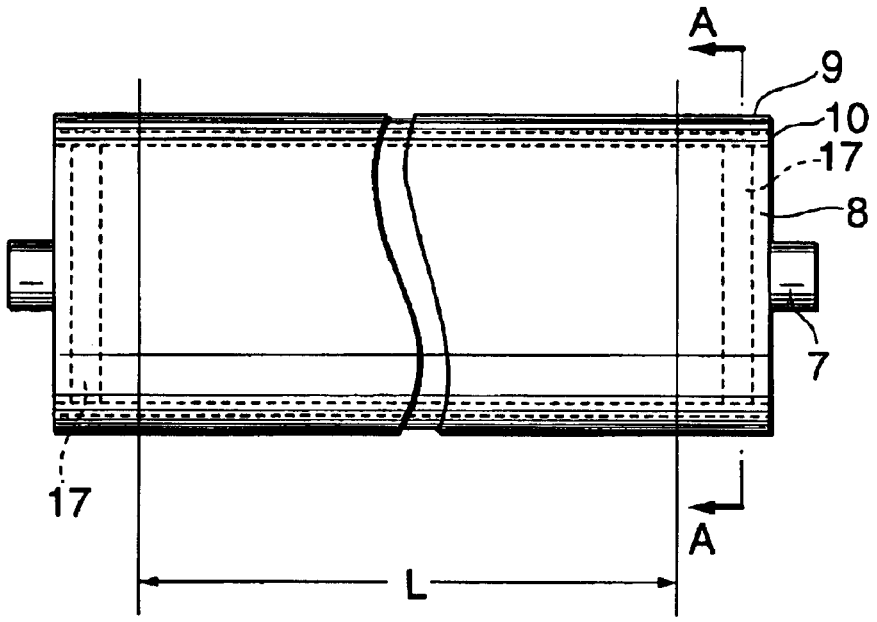
FIG. 8 is a modified embodiment (4) of the heating roller.
Figure 9:
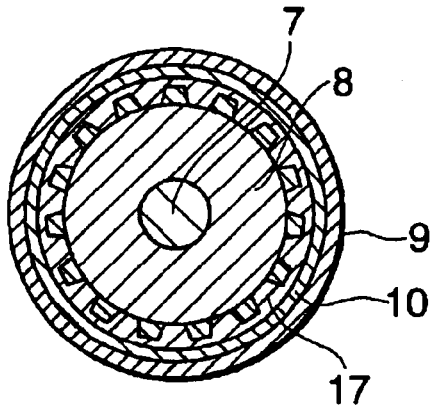
FIG. 9 is a view in the direction of the arrows taken along the line A—A of the fixing device in FIG. 1.

Furthermore, as shown in FIG. 7, a plurality of openings 16 may be provided at the end portions of the metal foil 10 out of range of the maximum paper width L of recording paper 2, so that the elastic body 8 and the elastic body layer 15 are connected through the openings to improve the adhesion and the sticking strength among the elastic body 8, the metal foil 10, and the elastic body layer 15.

To improve the adhesion and the sticking strength between the elastic body 8 and the metal foil 10, a sleeve member 17 of crenellated structure and made of resin or metal is fitted to the inside of the metal foil 10 out of range of the maximum paper width of recording paper 2. In this case, the adhesion between the metal foil 10 and the elastic body 8 can be improved without any effects on the deformation of the elastic body 8 that gives rise to an amount of nip N of the pressure-contact portions 6 of the rollers, which is required for fixing the toner.

In this embodiment, the temperature sensor 13 is so arranged as to contact the surface of the end portion of the heating roller 3 (outside the maximum paper width L of recording paper 2) as mentioned above, but as shown in FIG. 10, temperature sensors 18, 19 may be additionally provided, the former at the surface of the center portion of the heating roller 4, and the latter at the surface of its end portion, which does not contact the recording paper.

Figure 10:
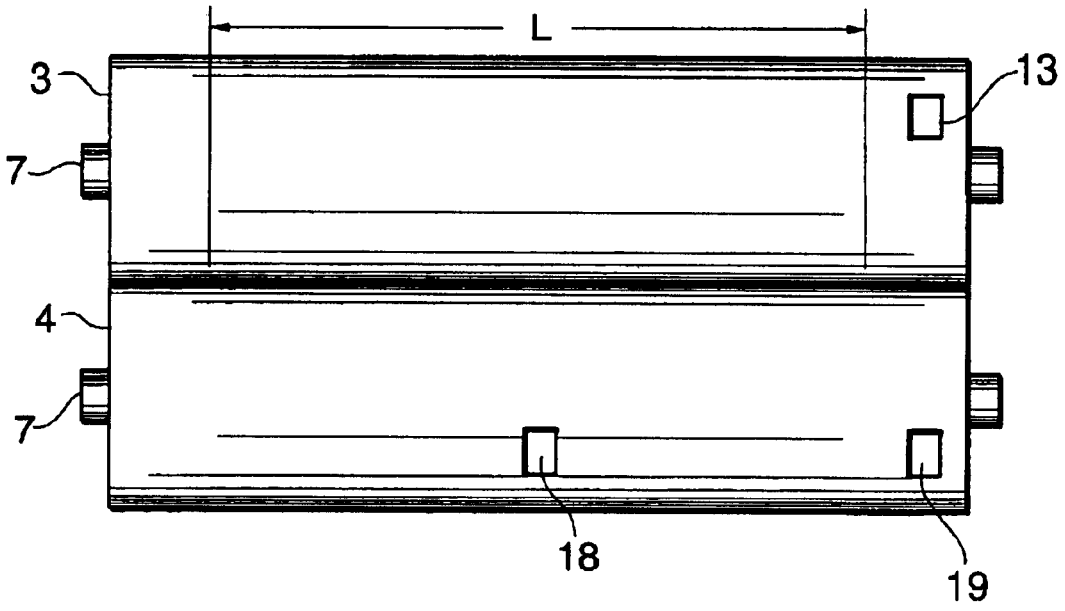
FIG. 10 shows a modified embodiment of the arrangement of the temperature sensors.
Figure 11:
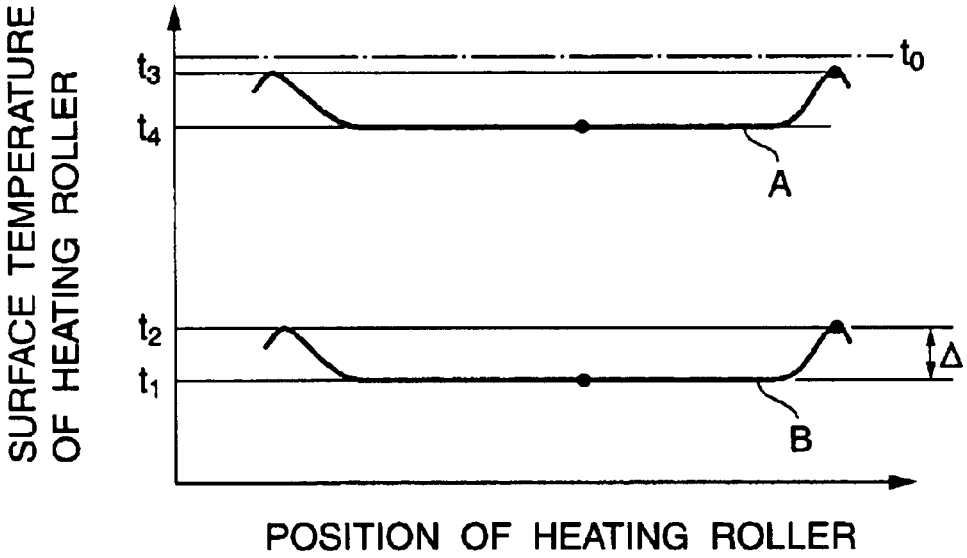
FIG. 11 is a diagram for explaining temperature control of the modified embodiment in FIG. 10.

FIG. 11 is an explanatory diagram of temperature control of the modified embodiment shown in FIG. 10. The horizontal axis indicates positions of the heating roller and the vertical axis indicates surface temperatures of the heating roller. The curves A and B respectively show the surface temperatures of the heating rollers 3, 4 when recording paper 2 having unfixed toner 5 adhering to it passed through the pressure-contact portions 6 of the rollers.

In temperature control, temperature t4 of the surface at the center portion of the heating roller 3 as a controlled temperature is compared with a predetermined temperature, and if the temperature t4 is higher than the predetermined temperature t0, power supply to the heating source of the heating roller 3 is stopped, or if the temperature t4 is lower than or equal to the predetermined temperature, power is supplied to the heating source of the heating roller 3.

When the recording paper 2 with unfixed toner 5 adhering to it passes through the pressure-contact portions 6 of the rollers, the surface temperatures of the heating rollers 3 and 4 become lower than the preset temperature t0 as the heat conducts to the recording paper 2.

The temperature variation in this case varies with differences in heat conductivity coefficient and heat capacity of the heating rollers 3 and 4.

During warming-up before the start of printing, the surface temperatures of the heating rollers 3 and 4 are controlled on the basis of a predetermined temperature t0.

When printing was started and recording paper 2 has passed the pressure-contact portions 6 of the rollers, the temperature gradient Δ of the heating roller 4 is calculated through the temperature sensors 18, 19.

$$\Delta = t2 - t1 \quad (1)$$

The temperature t4 of the surface at the center portion of the heating roller at this time is calculated from the temperature t3 and the temperature gradient Δ of the heating roller 3 obtained through the temperature sensor 13 and by using the following equation.

$$t4 = t3 - K \times \Delta \quad (2)$$

where the coefficient K is a value obtained experimentally. If a calculated surface temperature t4 is lower than or equal to the predetermined temperature t0, power is supplied to the heating source of the heating roller 3 to raise the temperature t3 of the surface at the end portion of the heating roller 3 detected through the temperature sensor 13 at this time by an amount corresponding to a temperature difference tx=(t0−t4).

By calculating the temperature t4 of the surface at the center portion of the heating roller 3 and controlling power to the heating source of the heating roller 3, a low temperature offset due to shortage of heat can be prevented from occurring.

Though in this embodiment the controlled temperature t4 is obtained by multiplying the temperature gradient Δ by the coefficient K obtained experimentally, and subtracting a resulting product from the temperature t3 of the surface at the end portion of the heating roller 3, but alternatively, a table may be generated experimentally, which includes temperature gradients Δ and temperatures t3 as reference elements and which is used to obtain controlled temperature t4, and this table may be used.

This temperature control method is not limited to the type of fixing device which is heated by contacting a heating source to the metal pipe, but may be applied to other types of fixing devices which has a heating source provided inside the heating roller.

According to the first embodiment, the metal foil with small heat capacity is heated directly by the halogen lamp, so that the heating rollers are heated quickly to be ready for printing.

According to this embodiment, the metal foil with small heat capacity is heated directly by the halogen lamp, if an attempt is made to increase printing speed, a required heat value can be obtained promptly without increasing the nip amount at the pressure-contact portions of the rollers by increasing the diameter of the rollers of an elastic body with low heat conductivity, and the device can be produced in reduced size.

Second Embodiment

Figure 12:
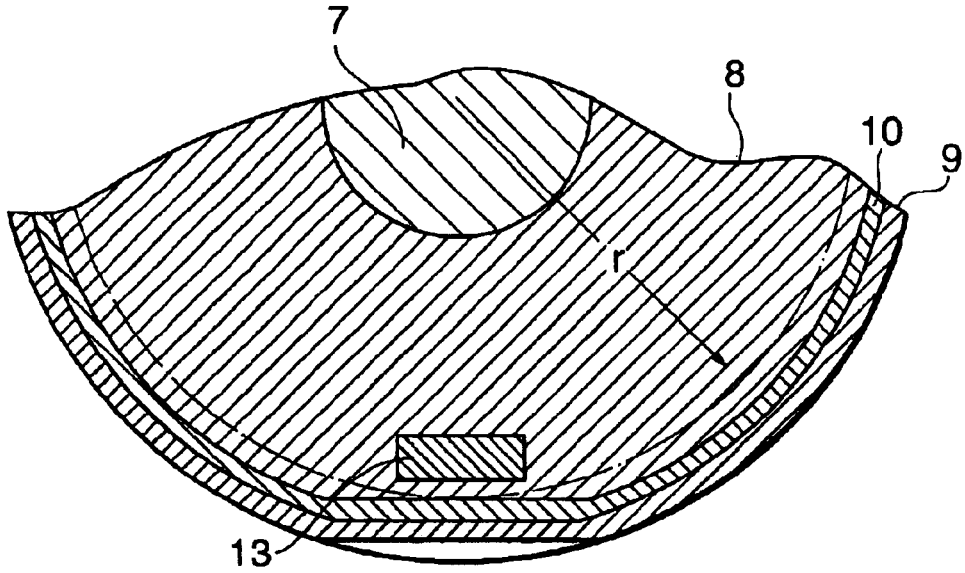
FIG. 12 is a partial sectional view of the heating roller according to a second embodiment of the invention.

FIG. 12 is a partial sectional view of a heating roller according to a second embodiment of the present invention. In this embodiment, a temperature sensor is embedded in the elastic body 8 of the heating roller 3. In other words, the temperature sensor 13 is embedded in that portion inside a radius r of the elastic body which is close to the metal foil 10 but does not affect the deformation that gives rise to the nip of the heating roller. Therefore, when manufacturing the heating roller 3, the temperature sensor 13 is disposed in the earlier-mentioned assembly before this assembly is filled with liquid silicon to form the elastic body 8.

When the temperature sensor is installed in contact with the surface of the heating sensor as has been shown in the first embodiment, the toner which has not been fixed to the recording paper 2 adheres to the heating roller. Part of the adhering toner sometimes gets past the foreign substance-removing blade 12, adheres to the temperature sensor, and sticks to and smears the recording paper 2.

Because the temperature sensor 13 is embedded in the heating roller, the problem mentioned above can be solved.

The operation of the fixing device in the second embodiment is the same as in the first embodiment, and therefore its description is omitted.

According to the second embodiment, because the temperature sensor 13 is embedded in the elastic body 8 of the heating roller 3, a trace amount of toner, which was not fixed to the recording paper, and adheres to the surface the heating roller 3, is removed by the blade before it adheres to the recording paper and grows to such an extent to smear the face of the paper.

Third Embodiment

Figure 13:
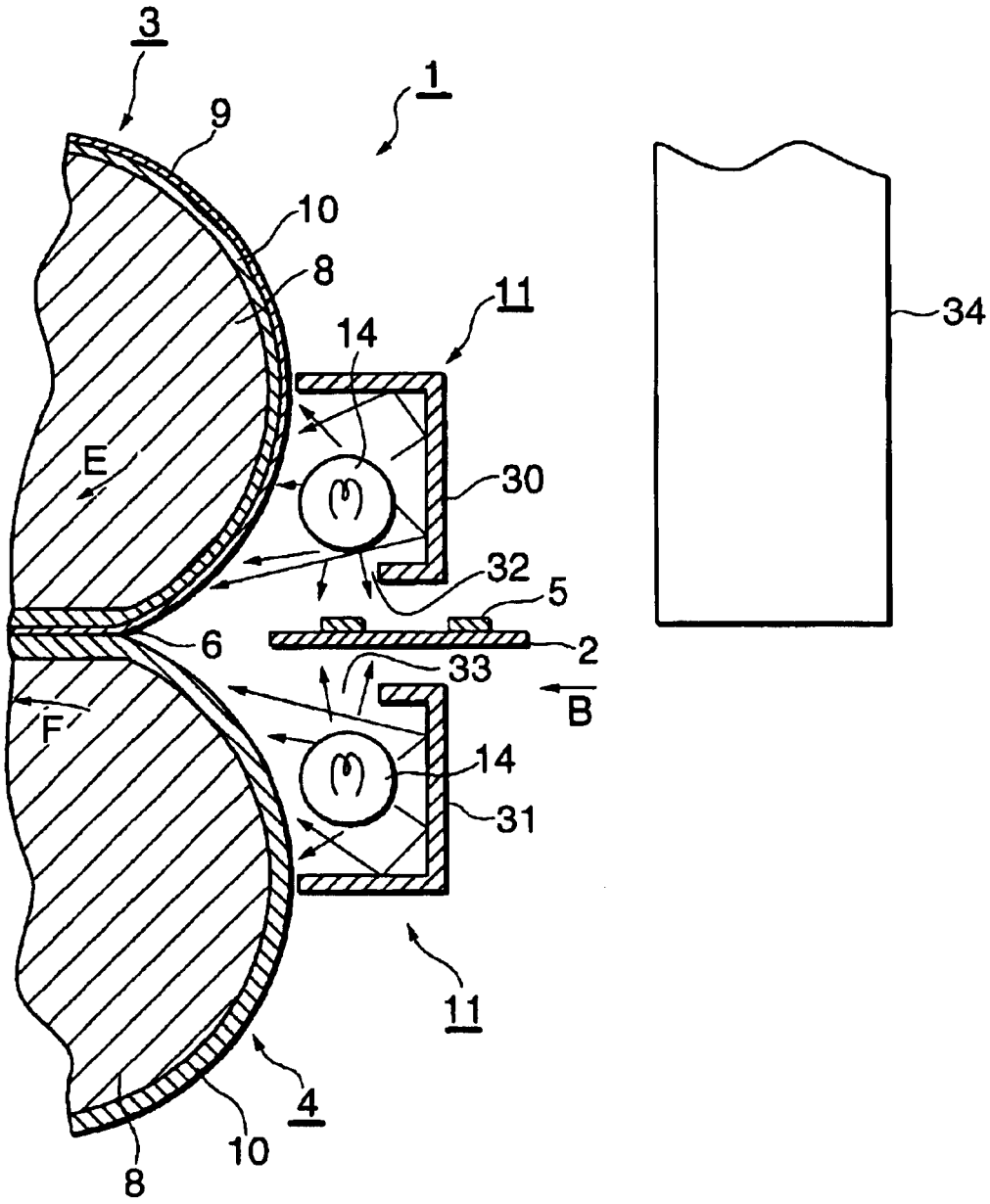
FIG. 13 is a sectional view of the fixing device according to a third embodiment of the present invention.

FIG. 13 is a sectional view of the fixing device according to a third embodiment of the present invention. In the third embodiment, the heating sources 11, 11 facing the surfaces of the heating rollers 3, 4, are covered by casings 30, 31 made of an adiabatic heat reflecting material are provided, and those casings have formed therein openings 32, 33 facing each other. Therefore, the recording paper 2, to which a toner image has been transferred by the image forming unit 34, is preheated by the heating sources 11, 11, and passes through the pressure-contact portions 6 of the rollers.

The operation of the fixing device in the third embodiment is the same as in the first embodiment, and therefore its description is omitted.

According to the third embodiment, because the casings for the heating sources are formed by an adiabatic heat reflecting material, it is possible to prevent heat effects on the devices arranged near the fixing device, such as the image forming unit for forming a toner image to be transferred to recording paper.

Because recording paper is preheated through the openings 32, 33 of the casings before it passes through the pressure-contact portions of the rollers, this helps the toner to be fixed more effectively.

Figure 14:
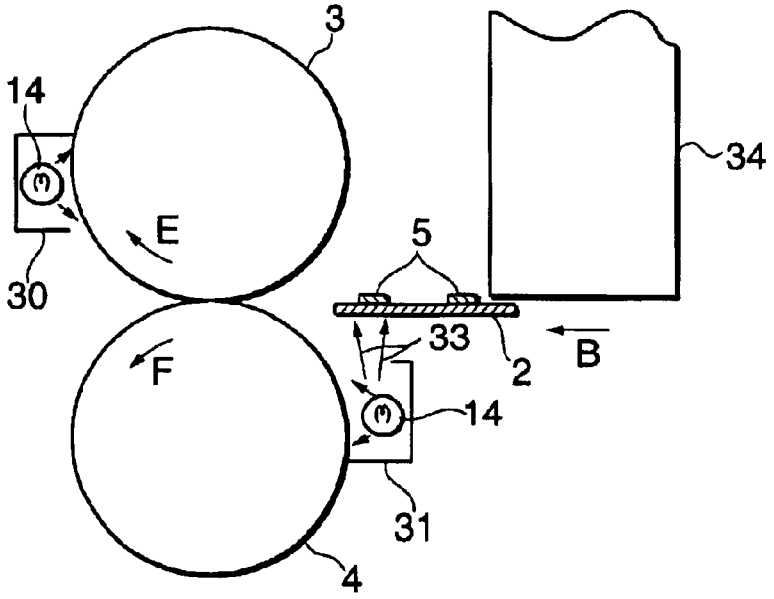
FIG. 14 is a modified embodiment of the fixing device according to the third embodiment of the present invention.

In the third embodiment, the heating sources 11, 11 provided facing the surfaces of the heating rollers 3, 4 are installed upstream of the pressure-contact portions of the rollers with respect to the rotating directions E, F of the rollers. However, as shown in FIG. 14, one heating source 11 provided facing the surface of the heating roller may be installed downstream of the pressure-contact portions of the rollers with respect to the rotating direction of the roller 3. In this case, the opening 33 for preheating the recording paper 2 is formed in the casing 31 for the heating source 11 installed facing the surface of the heating roller 4, but an opening is not provided in the casing 30 for the other heating source 11.

By the above arrangement, it is possible to further reduce the effects of heat on the devices arranged near the fixing device, such as the image forming unit for forming a toner image to be transferred to the recording paper.

Fourth Embodiment

Figure 15:
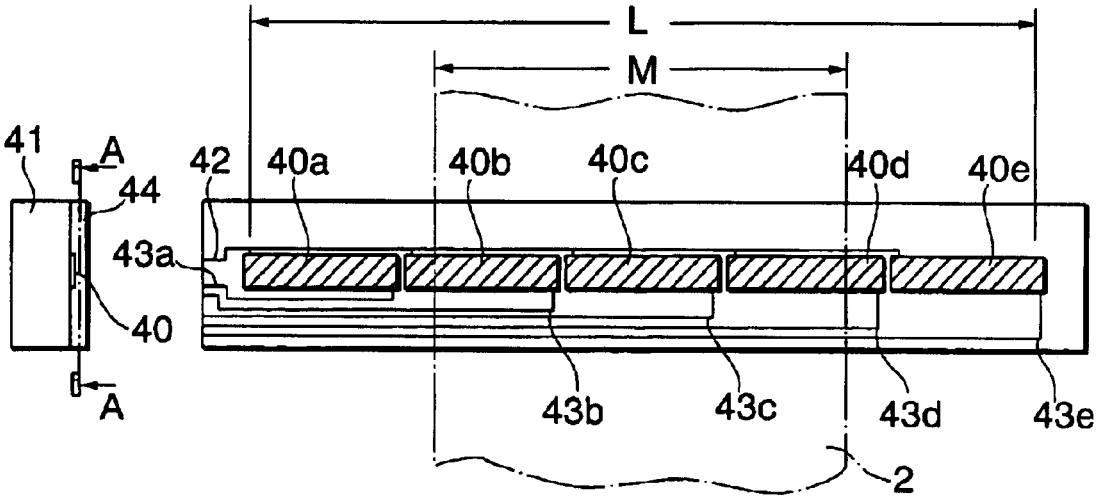
FIG. 15 is a construction diagram of the heating source according to a fourth embodiment of the present invention.

FIG. 15 is the construction diagram of the heating source according to a fourth embodiment of the present invention showing both a side view, and a sectional view taken in the direction of the arrows along the line A—A from the side view. The difference from the first embodiment is that the halogen lamp has been replaced by ceramic heaters 40 in the heating sources 11 arranged facing the surfaces of the heating rollers 3, 4.

In the fixing device according to the first embodiment, the heating source 11 heats uniformly across the maximum paper width L of the recording paper 2. When the surface temperatures of the heating rollers 3, 4 reach a predetermined temperature and the toner is fixed to the recording paper with a narrow width, the heat transfers from the center portions of the heating rollers 3, 4 to the recording paper 2, and the surface temperatures of the heating rollers 3, 4 become lower than the predetermined temperature, but the temperature drops less at the end portions of the heating rollers than at the center portions.

When the surface temperature of the heating roller 3 is lower than the predetermined temperature, power is automatically supplied to the heating source. And, when the center portion of the heating roller 3 reaches the predetermined temperature, the end portion of the heating roller, from which not much heat was transmitted to the recording paper, has become too hot. When recording paper 2 with a wider width than the previous recording paper 2 enters the pressure-contact portions 6 of the rollers, the so-called high-temperature offset phenomenon occurs that the toner, which has been fused by the roller 3, softens by the excessively high temperature of the roller 3, and sticks to the end portions of the roller 3, so that the recording paper 2 gets wound on the roller 3.

The advantage of the fixing device according to the fourth embodiment is its structure to prevent the high-temperature offset mentioned above.

More specifically, the ceramic heater 40 is provided on a heater board 41 made of ceramic, and is divided into multiple heater units 40*a*~40*e* of tantalum oxide or ruthenium oxide, for example, which are laid side by side in the width direction of the recording paper 2. The heater units 40*a*~40*e* are each connected at one end to a common wire 42 and at the other end to drive wires 43*a*~43*e*. The heater units 40*a*~40*e* are covered on their surfaces with a protective layer 44, which serves for insulation and abrasion resistance. The maximum width of the ceramic heater 40 is equal to the width L of the widest recording paper 2, and the dash-one dot lines indicate recording paper 2 with a width M narrower than the maximum width L of the heating source.

Figure 16:
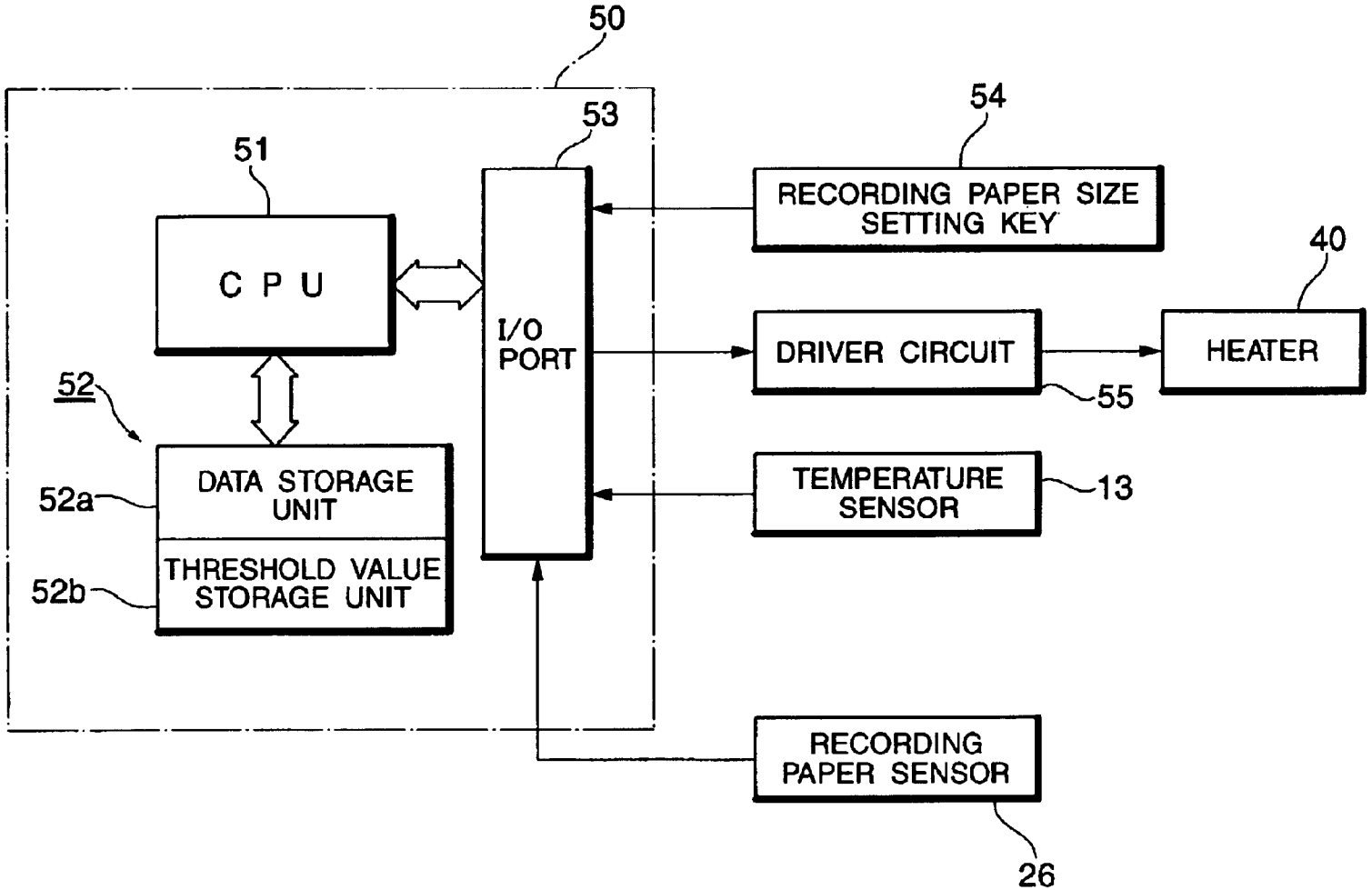
FIG. 16 is a control block diagram of the fixing device according to the fourth embodiment of the present invention.

FIG. 16 is a control block diagram of the fixing device according to the fourth embodiment. The controller 50 includes a central processing unit 51 (hereafter referred to as the CPU), memory 52 and an I/O port 53. The memory 52 includes a data storage unit 52*a* for storing data, and a threshold value storage unit 52*b* for storing a threshold value to control the temperature of the heating sources 11 to bring it to a predetermined temperature.

The CPU 51 is connected through the I/O port to a recording paper size setting key 54, a driver circuit 55, a temperature sensor 13, and a recording paper sensor 26. The driver circuit 55 is connected to the heater 40.

Figure 17:
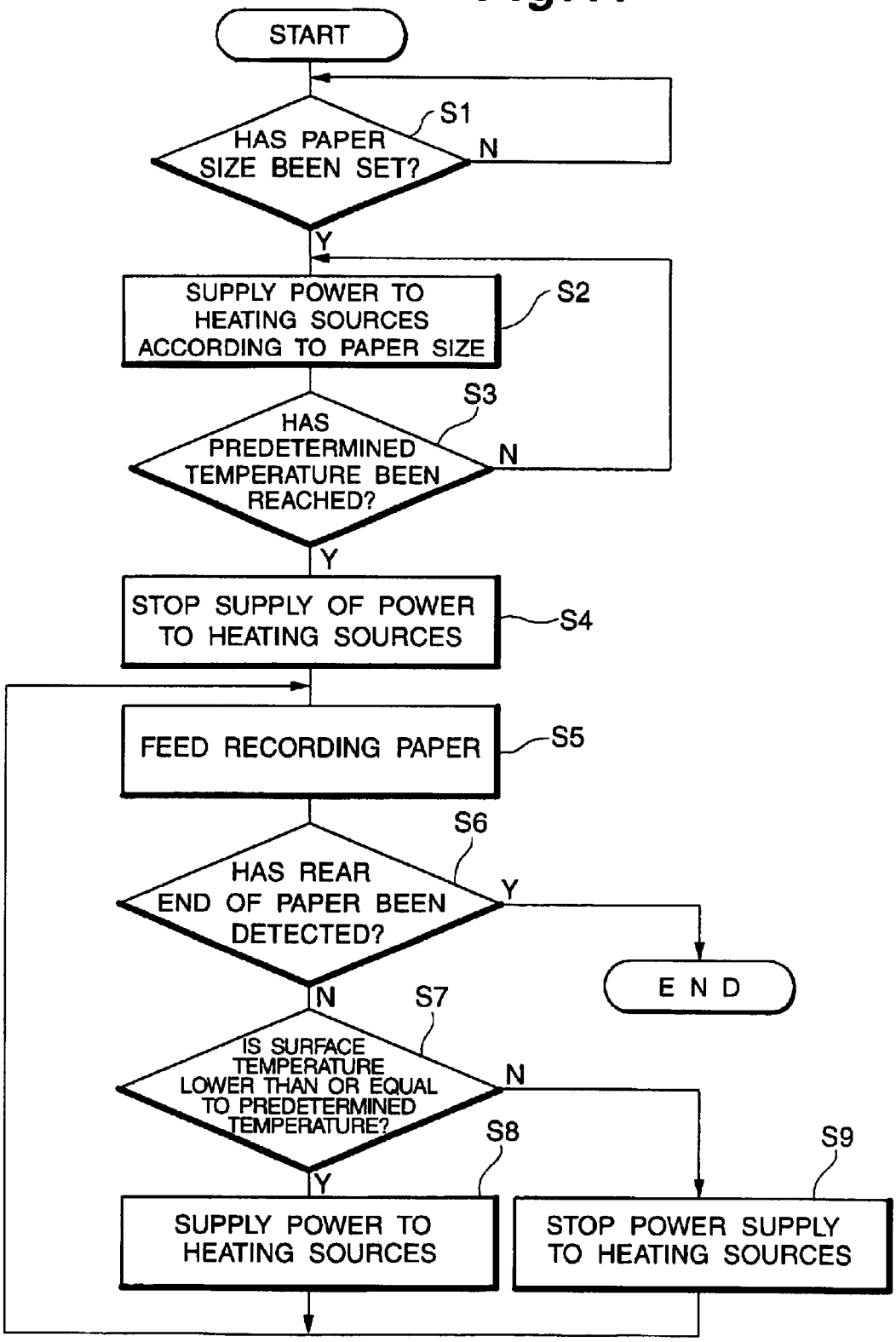
FIG. 17 is a flowchart showing the operation of the fixing device in FIG. 16.

The operation of the fixing device according to the fourth embodiment will be described with reference to FIG. 17. FIG. 17 is a flowchart showing the operation steps of the fixing device shown in FIG. 16. When the operator turns on a power switch, not shown, power is supplied to apparatus, such as an electrophotographic printer, and at the same time, the CPU 51 is reset to initialize the electrophotographic printer.

After the above initialization, at a step S1, the CPU 51 checks if a size of recording paper is entered from the recording paper size setting key 54, and if a recording paper size has been input, the operation of the fixing device proceeds to a step S2.

At the step S2, the CPU 51 directs the driver circuit 55 to supply power to the heater units as many as match the recording paper size.

At a step S4, the CPU 51 detects the surface temperature of the heating roller 3 through the temperature sensor, and compares the surface temperature with a threshold value stored in the memory 52. When the surface temperature of the heating roller 3 reaches the threshold value, the operation of the fixing device moves on to the step S4, of if the decision at the step S3 is no, the operation returns to the step S2.

At the step S4, the CPU 51 stops supply of power to the heating source 11, and at a step S5, the CPU 51 lets out recording paper 2 from a cassette, not shown, to feed it to the image forming unit. A toner image formed by the image forming unit is transferred to the recording paper 2, and the recording paper having the toner image transferred thereto is conveyed to the fixing device 1.

When, at a step S6, the CPU 51 detects the rear end of the recording paper through the recording paper sensor 26, if the decision of the step S6 is yes, the process for one piece of recording paper is finished, or if the decision is no, the operation moves on to a step S7.

At the step S7, the CPU 51 detects through the temperature sensor 13 whether the surface temperature of the heating roller 3 is lower than or equal to a predetermined temperature, and if the decision at the step S7 is yes, the operation moves on to a step S8, or if the decision is no, the operation moves on to a step S9.

At the step S8, the CPU 51 directs the driver circuit 55 to supply power to the heating source, and the operation returns to the step S5.

At the step S9, the CPU 51 stops supply of power to the heating source 11, and the operation returns to the step S5.

In this fourth embodiment, it has been arranged that the size of recording paper is set with the recording paper size setting key, but it may be arranged for the CPU to supply power to the heater on detecting a paper size by means of a paper width sensor which is to be installed on the paper moving track.

According to the fourth embodiment, the ceramic heater is used to directly heat the metal foil with small heat capacity, and therefore the roller temperature rises quickly.

The ceramic heater consists of heater subdivision units, which can be freely selected and heated, and the surface temperature of the heating rollers is detected by sensors arranged at their center and end portions, so that the surface temperature at the end portions of the heating rollers can be set at the same temperature as at the center portion. Therefore, it is possible to prevent the offset phenomenon that the toner, which has become molten by the high temperature of the roller 3, sticks to the surface of the roller 3, causing the recording paper 2 to get wound on the roller 3.

In the first to fourth embodiments, heating rollers are used for both the first and second rollers, but only the first roller may be formed by a heating roller, and the second roller is made a pressure roller without a heating source.

The parting agent layer is provided only on the first roller, but it is not provided on the second roller. However, the parting agent layer should preferably be mounted also on the second roller because the remaining toner is likely to be transferred from the first roller to the second roller, thus smearing the recording paper.

The elastic body layer is provided on the first roller, but not provided on the second roller as mentioned above. However, the elastic body layer should preferably be provided also on the second roller to improve the adhesion between the metal foil and the elastic body.

By adopting the foregoing configurations, the present invention provides the effects as follows.

In the first and the second roller, the elastic body formed by a heat-resistant material is covered on the outer surface tightly with the metal foil with small heat capacity, and the heating source is in contact with the outer surface of the metal foil to heat the metal foil. Because the metal foil is directly heated by the heating source, the temperature rise time of the heating roller is short.

Because the metal foil of small heat capacity is heated directly by the heating source, if one wishes to increase printing speed, it is possible to get a required heat value quickly without increasing the nip amount in the pressure-contact portions of the rollers by enlarging the diameter of the rollers of the elastic body of low heat conductivity, and the device in reduced size can be produced.

In the first to fourth embodiments, description has been made of the roller-type fixing device, which uses a pair of heating rollers. In addition, there is a belt-type fixing device, uses an endless belt applied between one of a pair of fixing rollers and a heating roller.

Each of a pair of the fixing rollers, the heating roller, and the fixing belt comprises an elastic body of a high heat resistance, and recording paper passes through the pressure-contact portions formed in the pair of fixing rollers through the intermediary of the fixing belt, by which the unfixed toner is fused to the recording paper.

Figure 19:
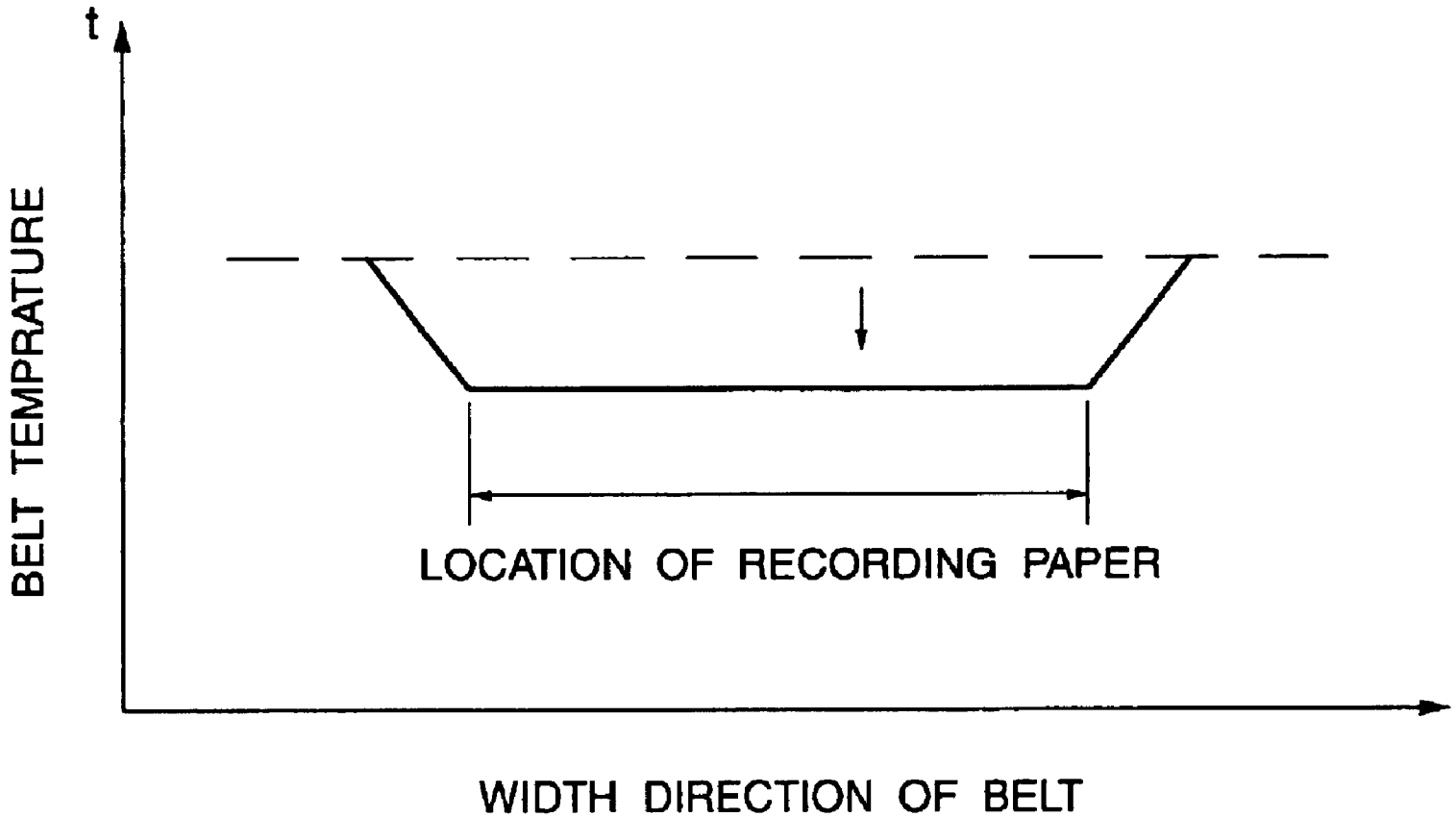
FIG. 19 is a diagram for explaining a belt-type fixing device according to the present invention.

Also with the belt-type fixing device, when an attempt was made to get an increase in printing speed as with the roller-type fixing device, because the heat capacity of the fixing belt for fixing the unfixed toner is small, as shown in FIG. 19, the heat was taken by the recording paper while it passed, and there was a great loss of belt temperature, which has been a problem.

Figure 20:
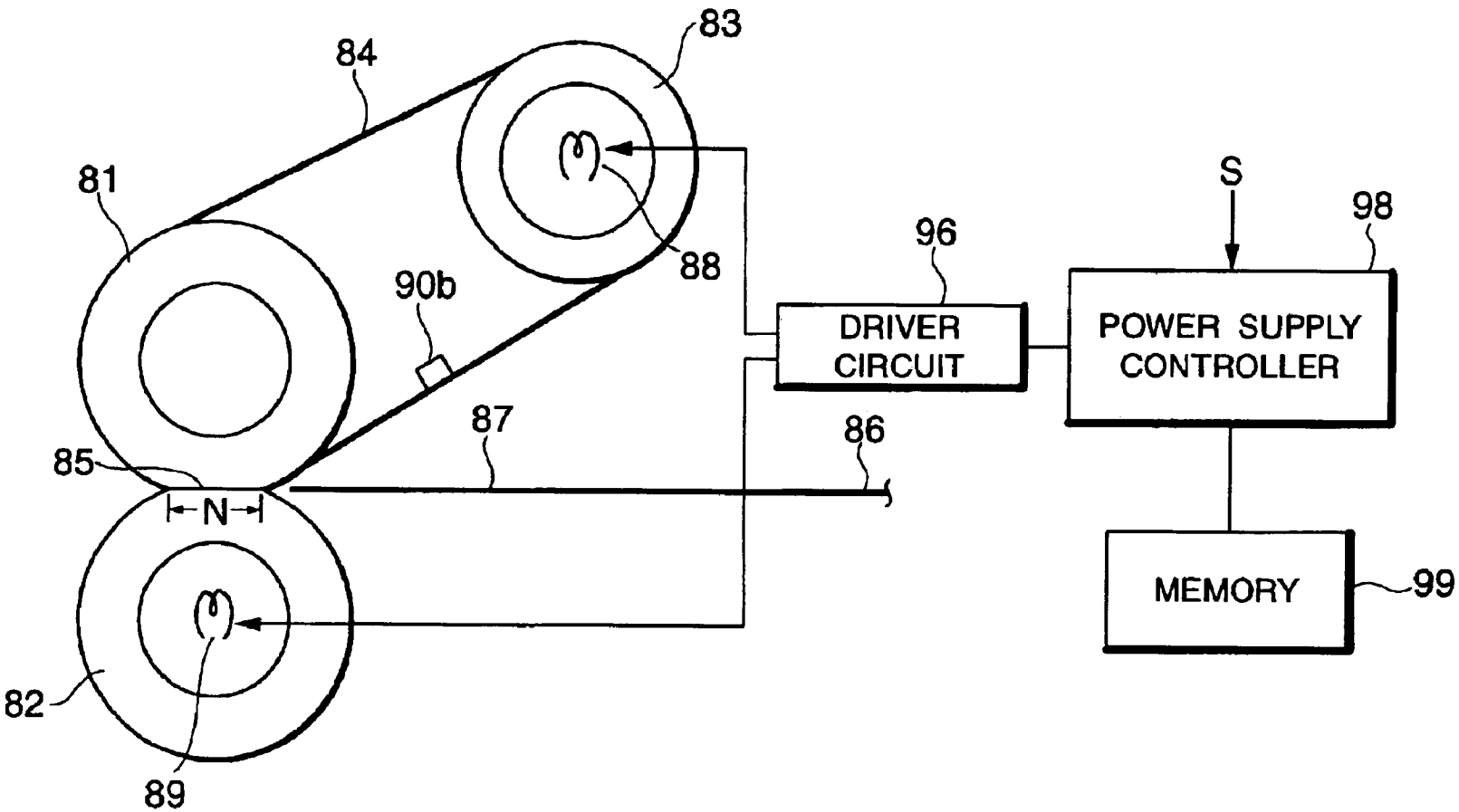
FIG. 20 is a schematic diagram of the belt-type fixing device according to the present invention.

FIG. 20 is a schematic diagram of a belt-type fixing device according to the present invention.

This fixing device comprises a pair of fixing rollers 81, 82, a heating roller 83 disposed separately from the one fixing roller 81, and a fixing belt 84 wound around the fixing roller 81 and the heating roller 83. The pair of fixing rollers 81, 82 are pressed together with interposition of the fixing belt 84, forming the nip amount N of the pressure-contact portions 85. The pair of fixing rollers 81, 82 each comprise an elastic body layer of a high heat resistance and large heat capacity. The heating roller 83 is made of metal pipe such as aluminum, and the metal pipe is coated on the circumferential surface with a fluorine resin. The fixing belt 84 is made of a heat-resistant resin, such as polyamide resin, or carbon steel or stainless steel, and is coated on the surface with a fluorine resin with a thickness of 50~100 $\mu$m, for example.

The heating roller 83 accommodates a heating source, such as a halogen lamp. On the other hand, the fixing roller 82 accommodates a heating source, such a halogen lamp. Those heating sources generate heat when they are supplied with power by a driver circuit 96. The driver circuit 96 is controlled by a power supply controller formed by a CPU, for example. Memory 99, connected to the power supply controller 98, stores data indicating a target temperature at which the outside of the fixing belt 84 is to be maintained.

A temperature sensor 90*b*, which is formed by a thermistor, for example, and contacts the inner surface of the fixing belt 84, is disposed at the center in the width direction of the belt. A detection signal (temperature) S of the temperature sensor 90*b* is supplied to the power supply controller 98.

Figure 21:
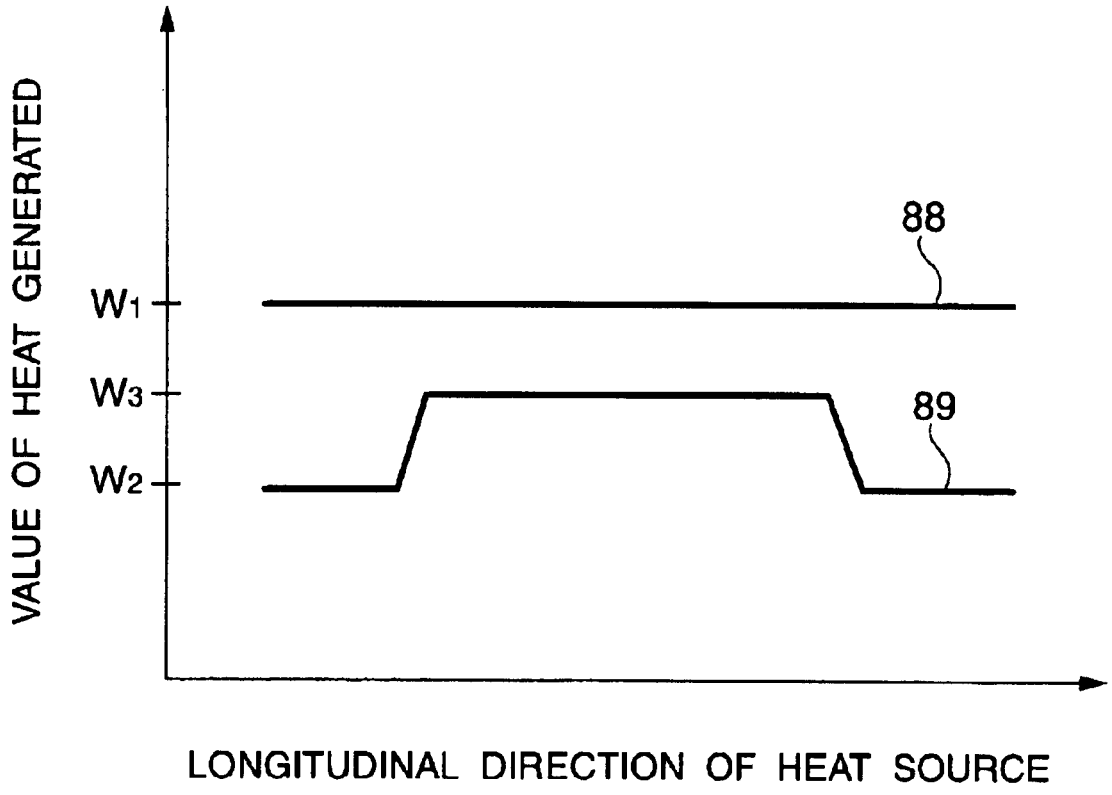
FIG. 21 is a view for explaining the heat values of respective heating sources shown in FIG. 20.

FIG. 21 is a diagram for explaining the heat value generated of the heating sources 88, 89. The vertical axis indicates the amount heat generated, and the horizontal axis indicates the positions in the longitudinal direction of the heating source. As is obvious from this graph, the heating source generates heat at a uniform heat value W1, while the other heating source generates heat at a heat value W3 lower than the heat value W1 at the center area, and at a lower heat value W2 at the side end portions.

Description will now be made of the operation of the fixing device. When recording paper 86 having unfixed toner 87 adhering to it passed through the pressure-contact portions 85, the recoding paper is heated by the fixing belt 84 and pressed by the pair of fixing rollers 81, 82 with interposition of the fixing belt 84, by which the toner 87 is fixed to the recording paper 86.

Meanwhile, the power supply controller 98 directs the driver circuit 96 to supply power to the heating source 88 to generate heat. More specifically, the power supply controller 98 receives target temperature data from the memory 99, and controls supply of power so that the detected temperature S of the temperature sensor 90*b* becomes the target temperature at the surface of the fixing belt 84 minus J where J denotes a temperature difference between the outside surface and the inner surface of the fixing belt 84.

When recording paper 86 is fed in continuously, there is a decrease in temperature at the center portion of the fixing belt 84, which contacts the recording paper 86. In this case, a detection signal S showing the temperature to start power supply is sent from the temperature sensor 90*b*, the power supply controller 98 start to control power supply to the heating sources 88, 89. In other words, the power supply controller 98 controls power supply to the heating sources 88, 89 so that the detected temperature S of the temperature sensor 90*b* comes to be the target temperature at the surface of the fixing belt 84 minus J.

By power supply control mentioned above, the heating source 89 generates heat with the heat value W2 at both side ends, with the result that the fixing belt 84 is so heated as to maintain substantially equal temperatures at both side ends and the center thereof Note that the temperature sensor 90*b* may be disposed facing the inner surface of the fixing belt 84 and in the vicinity of the circumferential surface of the heating roller 83.

Figure 22:
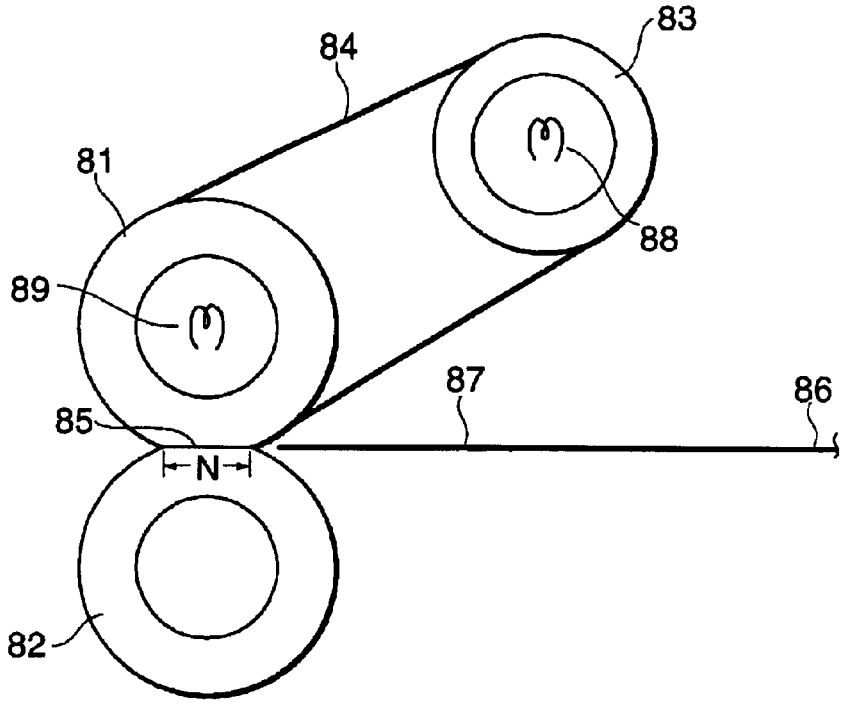
FIG. 22 is a schematic diagram of the belt-type fixing device according to a modified embodiment of the present invention.

Meanwhile, as shown in FIG. 20, the heating source 89 is accommodated in the other fixing roller 82, but the heating source 89 may be accommodated in the one fixing roller 81 as shown in FIG. 22. Or, the heating source 89 may be accommodated in the heating roller 83, and the other heating source 88 may be accommodated in the one fixing roller 81.

Figure 23:
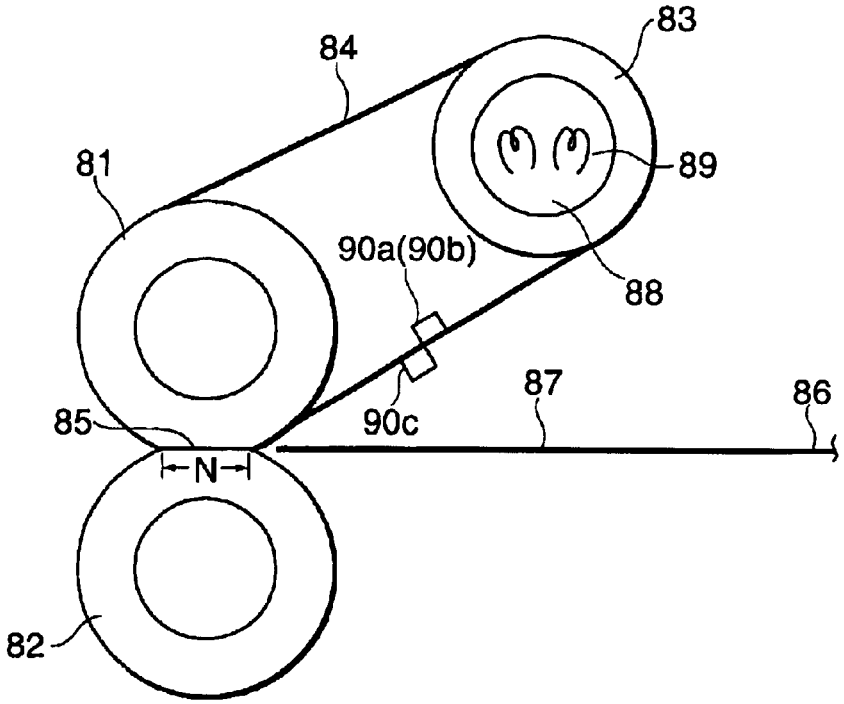
FIG. 23 is a schematic diagram of the belt-type fixing device according to another embodiment of the present invention.

FIG. 23 is a schematic diagram of a belt-type fixing device according to another embodiment of the present invention. A pair of fixing rollers 81, 82, a heating roller 83, and a fixing belt 84 are each formed of an elastic body of a high heat resistance and large heat capacity. The pair of fixing rollers 81, 82 are pressed together with interposition of the fixing belt 84, forming the nip amount N at the pressure-contact portions 85. The recording paper 86 passes through the pressure-contact portions 85, and the unfixed toner 87 is fused and fixed. The heating roller 83 includes a first heating source (a halogen lamp, for example) 88, and also a second heating source (a halogen lamp, for example) 89. The fixing belt 84 has temperature sensors 90*a*~90*c* pressed against it.

The first temperature sensor 90*a* contacts the inner surface and the edge portion of the fixing belt 84 which the recording paper does not contact, the second temperature sensor 90*b* contacts the inner surface and the center portion of the fixing belt 84, and the third temperature sensor 90*c* contacts the outer surface and the edge portion of the fixing belt 84 which the recording paper does not contact.

As shown in FIG. 21, the first heating source 88 generates heat at a heat value W1 uniformly regardless of the position in the longitudinal direction, while the second heating source 89 generates heat at a heat value W3 lower than the heat value W1 at the center of the belt, and at a heat value W2 at the edge portion of the belt, which is much lower than at the center portion of the belt.

Figure 24:
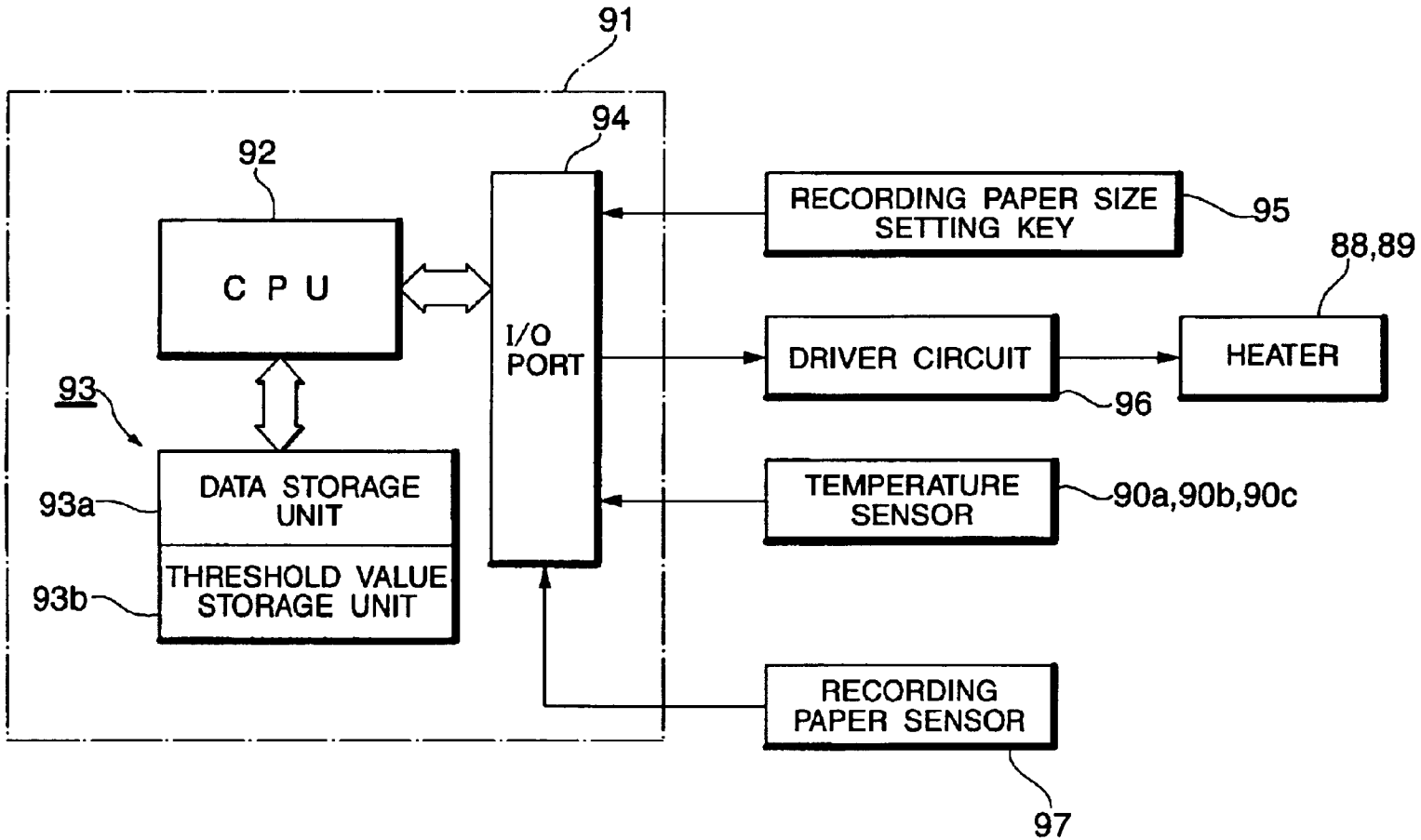
FIG. 24 is a control block diagram of the fixing device in FIG. 23.

FIG. 24 is a control block diagram of the fixing device shown in FIG. 23. The controller 91 comprises a central processing unit 92 (hereafter referred to as the CPU), memory 93, and an I/O port 94. The CPU92 is connected through the I/O port to a paper size setting key 95, a driver circuit 96, first, second and third temperature sensors 90*a*, 90*b*, 90*c*, and a paper sensor 97. The driver circuit 96 is connected to the first and second heating sources 88, 89.

The memory 93 comprises a data storage unit 93*a* for storing data, and a threshold value storage unit 93*b* for storing a temperature t1 to stop power supply and a temperature t2 to start power supply by which to control the temperatures of the heating sources 88, 89.

More specifically, the data storage unit 93*a* contains paper sizes set by the paper size setting key 95, and the threshold value storage unit 93*b* contains temperatures t1 to stop power supply and t2 to start power supply, and a coefficient K used to calculate the temperatures t1 and t2.

The CPU 92 calculates the temperature at the center portion on the outer surface of the fixing belt from a detected temperature t a third temperature sensor 90*c* contacting the edge portion of the fixing belt, and decides a temperature t1 to stop power supply and a temperature t2 to start power supply.

In calculating a temperature t1 to stop power supply and a temperature t2 to start power supply, a temperature difference Δt between a detected temperature by the first temperature sensor 90*a* and a detected temperature by the second temperature sensor 90*b* is obtained from the detected temperature t of the third temperature sensor 90*c*, then a temperature difference T between the center portion and the edge portion on the outer surface of the fixing belt is obtained by multiplying the temperature difference Δt by the coefficient K, moreover by subtracting the temperature difference T from the detected temperature t of the third temperature sensor 90*c*, a temperature t1 to stop power supply and a temperature t2 to start power supply are calculated.

Figure 25:
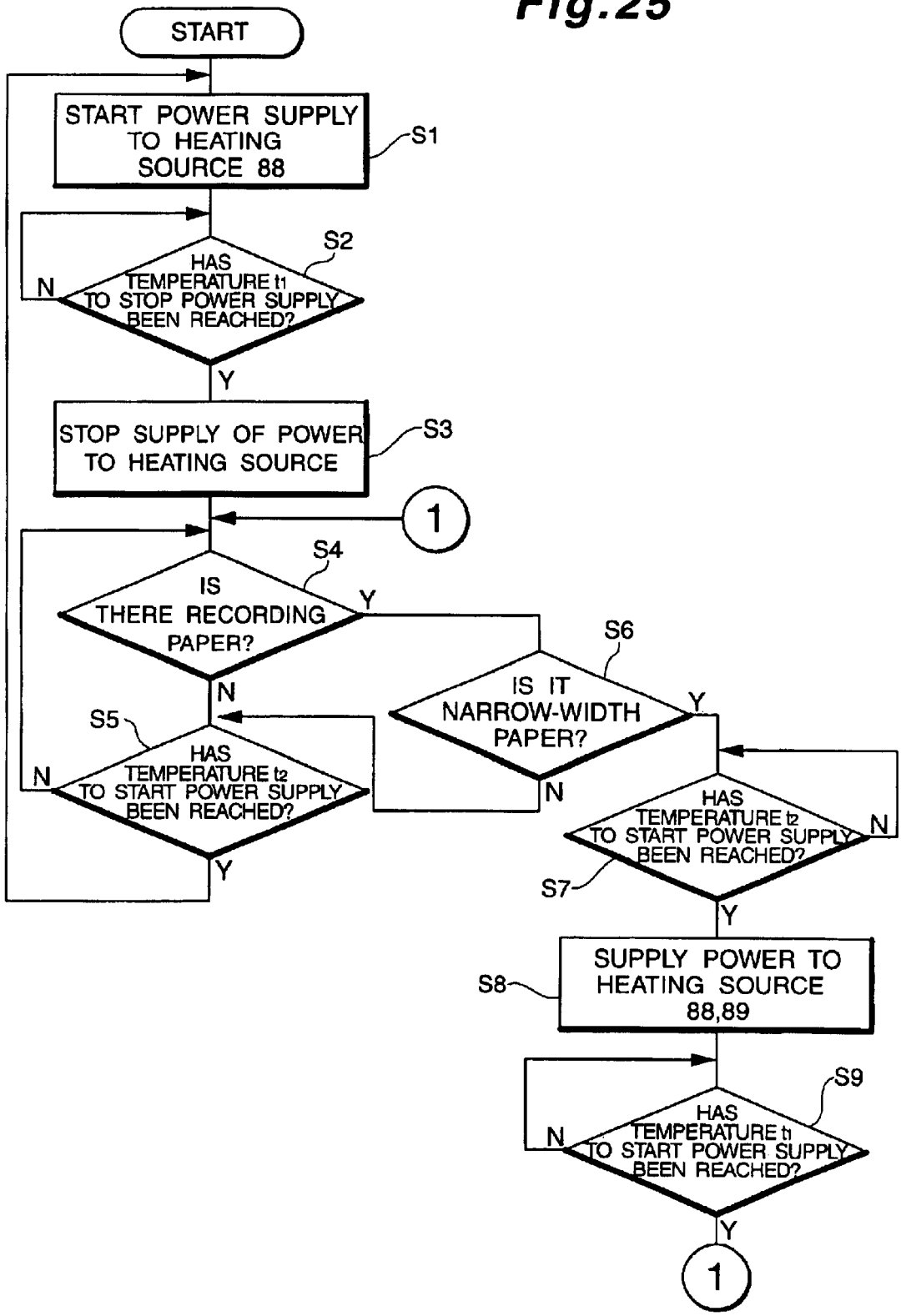
FIG. 25 is a flowchart showing the operation of the fixing device in FIG. 23.

The operation of the fixing device will be described with reference to FIG. 25, a flowchart showing the operation of the fixing device shown in FIG. 23. When the operator turns on the power switch, not shown, power is supplied to apparatus, a electrophotographic printer, and at the same time, the CPU 92 is reset to initialize the printer.

At a step S1, the CPU 92 directs the driver circuit 96 to supply power to the first heating source 88, and at a step S2,. the surface temperature at the center portion on the outer surface of the fixing belt is calculated from the detected temperature t by the third temperature sensor 90*c*, which is compared with the temperature t1 to stop power supply stored in the memory 93. When the surface temperature at the center portion on the outer surface of the fixing belt 84 reaches the temperature t1 to stop power supply, the operation proceeds to a step S3.

At the step S3, the CPU 92 stops supply of power to the heating source. At a step S4, the CPU 92 detects through the paper sensor 97 whether there is recording paper or not. If the decision at the step S4 is yes, the operation moves on to a step S6, of if the decision is no, the operation moves on to a step S5.

At the step S5, the CPU 92 calculates the surface temperature at the center portion on the outer surface of the fixing belt from a detected temperature t by the third temperature sensor 90*c*, and compares the surface temperature with the temperature t stored in the memory 93. When the surface temperature at the center portion on the outer surface of the fixing belt 84 reaches the temperature t2 to start supply of power, the operation returns to the step S1, or if the decision at the step S5 is no, the operation moves back to the step S4.

At the step S6, the CPU 92 refers to the data storage unit 93*a*, checks to see if the recording paper is narrow-width paper, and if the paper is narrow-width paper, the operation moves on to a step S7, or if the decision is no, the operation goes back to the step S5.

At the step S7, the CPU 92 calculates the surface temperature at the center portion on the outer surface of the fixing belt from a detected temperature t by the third temperature sensor 90*c*, and compares the surface temperature with the temperature t2 to start power supply stored in the memory 93. When the surface temperature at the center portion on the outer surface of the fixing belt 84 reaches the temperature t2 to start power supply, the operation proceeds to a step S8.

At the step S8, the CPU 92 directs the driver circuit 96 to supply power to the first and second heating sources 88, 89.

At a step S9, the CPU 92 calculates the surface temperature at the center portion on the outer surface of the fixing belt from a detected temperature t by the third temperature sensor 90*c*, and compares with the surface temperature with the temperature t1 to stop power supply stored in the memory 93. When the surface temperature at the center portion on the outer surface of the fixing belt 84 reaches the temperature t1 to stop power supply, the operation moves back to the step S4.

When narrow-width paper is fed continuously, the steps S4~S9 are repeated. When the surface temperature at the center portion on the outer surface of the fixing belt 84 reaches the temperature t2 to start power supply, power is supplied to the first and second heating sources 88, 89, by which optimum fixing temperature is secured so as to reduce a temperature difference between the center portion and the edge portion of the fixing belt.

Meanwhile, when the paper size is set by depressing the paper size setting key 95, an interrupt occurs, and the paper size that has been set is stored in the data storage unit 93*a*. Recording paper is supplied after the fixing belt reaches the temperature t1 to stop power supply.

In this embodiment, the first heating source 88 and the second heating source 89 are together provided inside the heating roller 83, but the first heating source 88 may be provided in the heating roller 83, and the second heating source 89 may be provided in the fixing roller 81 or the fixing roller 82. In this case, a decrease in temperature at the center portion of the belt by passage of one piece of paper after another may be compensated by using a fixing roller of great heat capacity, to decrease irregular temperature distribution in the belt.

Or, the first heating source 88 may be provided one each in the heating roller 83, the fixing rollers 81, 82. In this case, the fixing belt 84 is heated by the heating source 88 of the heating roller 83, and is heated by the heating sources 88 of the fixing rollers of great heat capacity, so that the temperature drop at the center portion of the belt by passage of one after another piece of paper can be compensated by fixing rollers of large heat capacity, so that temperature irregularity in the belt can be reduced.

According to this embodiment, a temperature drop at the center portion of the belt is obtained from a detected temperature by the temperature sensor contacting the edge portion of the fixing belt which does not contact recording paper, and the fixing belt is heated by a heating source the heat value of which is higher at the center portion than at the edge portion of the belt, with the result that even if the fixing belt is deprived by recording paper of heat while the paper travels, a temperature difference between the center portion and the edge portion of the belt can be reduced. Therefore, the temperature of the fixing belt can be set at an optimum fixing temperature regardless of the width of recording paper.

What is claimed is:

1. A fixing device for passing a recording sheet having unfixed toner adhering thereto through a first and a second roller pressed together, and fusing said toner under heat and pressure and fixing said toner to said recording sheet, wherein said first roller heated by a heating source comprises:

an elastic body having a high heat resistance and low heat conductivity coefficient, provided around a mandrel;

a heat layer formed to a circumferential surface of said elastic body; and a parting agent layer with water and oil repellency, formed to a circumferential surface of said heat layer; and wherein said second roller comprises an elastic body, and a metal layer formed on a surface of the elastic body of said second roller.

2. A fixing device according to claim 1, wherein said second roller is heated by another heating source and comprises the elastic body which is provided on a mandrel and has a high heat resistance and a low heat conductivity coefficient, and the metal layer which is formed on the circumferential surface of said elastic body and has a small heat capacity.

3. A fixing device according to claim 2, wherein said second roller further comprises a parting agent layer formed on the circumferential surface of said metal layer.

4. A fixing device according to claim 3, wherein said second roller further comprises an elastic body layer of a high heat resistance and a high heat conductivity coefficient formed between said metal layer and said parting agent layer.

5. A fixing device according to claim 2, wherein said another heating source is covered with a casing lined on an internal surface with an adiabatic heat reflecting material and having an opening open to said recording sheet to preheat said recording sheet.

6. A fixing device according to claim 5, wherein said other heating source has a plurality of heat generating units arranged along a rotating axis of said second roller, and wherein said plurality of heat generating units are controlled to selectively generate heat according to the width of said recording sheet.

7. A fixing device according to claim 2, wherein said heating source is arranged on a downstream side of a running direction of said recording sheet to heat said first roller, said another heating source is arranged on an upstream side of the running direction of said recording sheet to heat said second roller, said another heating source having a casing which has an opening facing said recording sheet to preheat said recording sheet, and an internal surface made up of an adiabatic heat reflecting material.

8. A method for manufacturing the second roller according to claim 2, comprising the steps of:

immersing a cylindrical electrode having an insulating layer on the outer circumference thereof and a metal material to form the metal layer in an electrolytic solution, connecting said cylindrical electrode to the negative pole and said metal material to the positive pole of a power supply to thereby cause the metal layer to precipitate on the inside surface of the cylindrical electrode by electroplating;

supporting said mandrel at the center of the inside of said cylindrical electrode, injecting a liquid elastic material to the inside of the metal layer, and forming an elastic body by crosslinking.

9. A fixing device according to claim 1, wherein said heating source has a plurality of heat generating units arranged along a rotating axis of said first roller, and wherein said plurality of heat generating units are controlled to selectively generate heat according to the width of said recording sheet.

10. A fixing device according to claim 9, wherein said width of said recording sheet is designated by an operation key.

11. A fixing device according to claim 9, wherein said width of said recording sheet is detected by a paper width sensor disposed on the running path of said recording sheet.

12. A fixing device according to claim 1, wherein said first roller comprises a temperature sensor embedded in the vicinity of said heat layer of said elastic body and in a position not to obstruct a nip deformation of said elastic body.

13. A fixing device according claim 1, wherein said first roller further comprises an elastic body layer disposed between said heat layer and said parting agent layer, and wherein there are provided a plurality of openings in both ends of said heat layer to connect said elastic body and said elastic body layer.

14. A fixing device according to claim 1, wherein a width of said heat layer is greater than a maximum-width of the recording sheet.

15. A method for manufacturing the first roller according to claim 1, comprising the steps of:

forming the heat layer from a metal foil formed in a cylindrical shape, and applying a parting agent material to an outer circumference of said metal foil, and forming the parting agent layer by baking for crosslinking; and arranging the mandrel at the center of the inside of said metal foil, injecting a liquid elastic material to the inside of said metal foil, and forming the elastic body by crosslinking.

16. A method for manufacturing said first roller according to claim 1, comprising the steps of:

forming the heat layer from a metal foil formed in a cylindrical shape;

applying an elastic material with a high heat conductivity coefficient to an outer circumference of said metal foil, and forming an elastic body layer by baking for crosslinking reaction;

applying a parting agent layer to an outer circumference of said elastic body layer, forming said parting agent layer by baking for crosslinking; and arranging said mandrel at the center of the inside of said metal foil, injecting a liquid elastic material to the inside of said metal foil, and forming the elastic body by crosslinking.

17. A method for manufacturing said first roller according to claim 1, comprising the steps of:

immersing a cylindrical electrode having an insulating layer on an outer circumference thereof and a metal material to form the heat layer in an electrolytic solution, connecting said cylindrical electrode to the negative pole and said metal material to the positive pole of a power supply to thereby cause the heat layer to precipitate on the inside surface of the cylindrical electrode by electroplating;

supporting said mandrel at the center of the inside of said cylindrical electrode, injecting a liquid elastic material to the inside of the heat layer, and forming the elastic body by crosslinking; and removing said cylindrical electrode, applying a parting agent material to the outer circumference of said heat layer, and forming the parting agent layer by baking for crosslinking.

18. A method for manufacturing said first a roller according to claim 17, further comprising the steps of:

dispersing fine fluorine powder in said electrolytic solution to cause a metal foil containing fluorine powder to precipitate on the inside surface of said cylindrical electrode to form the heat layer; and subjecting said metal foil to heat treatment at a predetermined temperature and for a predetermined time.

19. A method for manufacturing said first roller according to claim 1, comprising the steps of:

immersing a cylindrical electrode having an insulating layer on an the outer circumference thereof and a metal material to form the heat layer in an electrolytic solution, connecting said cylindrical electrode to the negative pole and said metal material to the positive pole of a power supply to thereby cause a metal foil to precipitate on the inside surface of the cylindrical electrode by electroplating, thereby forming the heat layer;

supporting said mandrel at the center of the inside of said cylindrical electrode, injecting a liquid elastic material to the inside of the metal foil, and forming the elastic body by crosslinking; and removing said cylindrical electrode, applying an elastic material with a high heat conductivity coefficient and a parting agent material to an outer circumference of said metal foil in this order, and forming an elastic body layer and the parting agent layer by baking for crosslinking.

20. A method of manufacturing said first roller according to claim 1, comprising the steps of:

holding the mandrel in a mold, and injecting an elastic material to form the elastic body;

immersing said elastic body in a palladium chloride solution to cause palladium to precipitate on the surface thereof, and after rinsing said elastic body with water, causing a metal foil to precipitate by electroless plating to form the heat layer; and cutting off both end portions of said metal foil, applying a parting agent material to an outer surface of said metal foil for crosslinking, and baking to form the parting agent layer.

21. A method for manufacturing roller according to claim 20, further comprising the steps of previously dispersing palladium in said elastic material to form said elastic body, and causing said metal foil to precipitate by electroless plating.

22. A fixing device according to claim 1, wherein said heat layer is one of a metal layer with small heat capacity and an organic matter layer containing metal.

23. A fixing device for passing a recording sheet having unfixed toner adhering thereto through a first and a second roller pressed together, and fusing said toner under heat and pressure and fixing said toner to said recording sheet, wherein said first roller heated by a heating source comprises:

an elastic body having a high heat resistance and low heat conductivity coefficient, provided around a mandrel;

a heat layer formed to a circumferential surface of said elastic body; and a parting agent layer with water and oil repellency, formed to a circumferential surface of said heat layer, wherein said first roller further comprises an elastic body layer which has a high heat resistance and a high heat conductivity coefficient and is formed between said heat layer and said parting agent layer.

24. A fixing device for passing a recording sheet having unfixed toner adhering thereto through a first and a second roller pressed together, and fusing said toner under heat and pressure and fixing said toner to said recording sheet, wherein said first roller heated by a heating source comprises:

an elastic body having a high heat resistance and low heat conductivity coefficient, provided around a mandrel;

a heat layer formed to a circumferential surface at said elastic body; and a parting agent layer with water and oil repellency, formed to a circumferential surface of said heat layer, wherein both ends of said heat layer are fitted to crenellated sleeve members tightly attached to the circumferential surfaces at the end portions of said elastic body.

25. A fixing device for passing a recording sheet having unfixed toner adhering thereto through a first and a second roller pressed together, and fusing said toner under heat and pressure and fixing said toner to said recording sheet, wherein said first roller heated by a heating source comprises:

an elastic body having a high heat resistance and low heat conductivity coefficient, provided around a mandrel;

a heat layer formed to a circumferential surface of said elastic body; and a parting agent layer with water and oil repellency, formed to a circumferential surface of said heat layer, wherein said heating source is covered with a casing lined on its internal surface with an adiabatic heat reflecting material, said casing having an opening facing both said recording sheet and said first roller, to simultaneously preheat said recording sheet and heat said first roller.

26. A method for temperature control of a fixing device for passing recording sheet having unfixed toner adhering thereto through a first and a second roller heated by heating sources, and fusing said toner under heat and pressure and fixing said toner to said recording sheet, comprising the steps of:

bringing a first temperature sensor into contact with a circumferential surface of an end portion of said first roller not contacting said recording sheet;

bringing a plurality of second temperature sensors into contact with a center-portion circumferential surface of said second roller contacting said recording sheet, and also into contact with said end-portion circumferential surface of said second roller not contacting said recording sheet;

selling a predetermined temperature for the circumferential surface of said first roller to be maintained;

determining a temperature difference between the center-portion circumferential surface and the end-portion circumferential surface of said second roller from detected temperatures by said plurality of second temperature sensors;

obtaining a temperature of said center-portion circumferential surface of said first roller from said determined temperature difference and a temperature detected by said first temperature sensor; and if said temperature of said center-portion circumferential surface is lower than said predetermined temperature, supplying power to said heating source to heat said first roller.

27. A fixing device having a heating roller heated by a heating source, a fixing belt wound around said heating roller and a first roller, and a second roller pressed to said first roller with interposition of said fixing belt, wherein a recording sheet having unfixed toner adhering thereto is passed between said second roller and a portion of said fixing belt being pressed to said second roller, and said toner is fused under heat and pressure and fixed to said recording sheet, comprising:

a temperature sensor arranged adjacent to an inside surface of said fixing belt, and approximately at the center portion of said fixing belt; and a power supply controller for controlling power supply to said heating source by comparing a detected temperature by said temperature sensor with a fixing temperature preset for said fixing belt.

28. A fixing device according to claim 27, wherein said temperature sensor is arranged close to said center portion on the inner surface of said fixing belt.

29. A fixing device according to claim 27, wherein said heating roller is a heat roller including a metal pipe arranged inside said heating source.

30. A fixing device according to claim 27, further comprising another heating source to heat either one of said first roller and said second roller.

31. A fixing device according to claim 30, wherein said another heating source is provided inside the roller.

32. A fixing device according to claim 30, wherein said another heating source generates heat with a larger heat value at the center portion than at a side end portion.

33. A fixing device according to claim 30, wherein said another heating source differs in heat value from said heating source, and wherein generates heat at a larger heat value at the center portion than at a side end portion thereof.

34. A fixing device according to claim 27, wherein said heating source generates heat with a larger heat value at the center portion than at a side end portion thereof.

35. A fixing device according to claim 27, wherein said heating source comprises two heaters different in heat value.

36. A fixing device according to claim 35, wherein said heating source comprises two heaters different in heat value, and one of said heaters generates heat with a larger heat value at the center portion than at a side end portion thereof.

37. A fixing device according to claim 27, further comprising:

a temperature sensor for outer side use for detecting a temperature of a side end portion on the outer side of said fixing belt, wherein said power supply controller controls power supply to said heating source by comparing detected temperatures of said temperature sensors and said temperature sensor for outer side use with said preset fixing temperature.

38. A fixing device according to claim 27, further comprising:

a temperature sensor for use at a side end portion on the inner side for detecting a temperature at a side end portion on the inner side of said fixing belt; and a temperature sensor for use at the outer side for detecting a temperature at side end portion on the outer side of said fixing belt, wherein said power supply controller controls power supply to said heating source by comparing detected temperatures by said temperature sensors, said inner-side end-portion temperature sensor, and said outer-side temperature sensor with said preset fixing temperature.

39. A fixing device according to claim 27, wherein the center portion of said fixing belt is disposed between two opposing longitudinal edges of said fixing belt.

40. A fixing device having a heating roller heated by a heating source, a fixing belt wound around said heating roller and a first roller, and a second roller pressed to said first roller with interposition of said fixing belt, wherein a recording sheet having unfixed toner adhering thereto is passed between said second roller and a contacting portion of said fixing belt that is pressed to said second roller by said first roller, and said toner is fused under heat and pressure and fixed to said recording sheet, said heating roller being positioned to be directly over said recording sheet prior to the recording sheet passing between said second roller and said contacting portion, comprising:

a temperature sensor arranged adjacent to an inside surface of said fixing belt, and approximately at a center portion of said fixing belt; and a power supply controller for controlling a power supply to said heating source by comparing a detected temperature by said temperature sensor with a fixing temperature preset for said fixing belt.

41. A fixing device according to claim 40, wherein said temperature sensor is arranged close to said center portion on the inner surface of said fixing belt.

42. A fixing device according to claim 40, wherein said heating roller is a heat roller including a metal pipe arranged inside said heating source.

43. A fixing device according to claim 40, further comprising another heating source to heat either one of said first roller and said second roller.

44. A fixing device according to claim 43, wherein said another heating source is provided inside the one of said first roller and said second roller.

45. A fixing device according to claim 43, wherein said another heating source generates heat with a larger heat value at the center portion than at a side end portion.

46. A fixing device according to claim 43, wherein said another heating source differs in heat value from said heating source, and generates heat at a larger heat value at the center portion than at a side end portion thereof.

47. A fixing device according to claim 40, wherein said heating source generates heat with a larger heat value at the center portion than at a side end portion thereof.

48. A fixing device according to claim 40, wherein said heating source comprises two heaters different in heat value.

49. A fixing device according to claim 48, wherein said heating source comprises two heaters different in heat value, and one of said heaters generates heat with a larger heat value at the center portion than at a side end portion thereof.

50. A fixing device according to claim 40, further comprising:

a temperature sensor for outer side use for detecting a temperature of a side end portion on the outer side of said fixing belt, wherein said power supply controller controls power supply to said heating source by comparing detected temperatures of said temperature sensors and said temperature sensor for outer side use with said preset fixing temperature.

51. A fixing device according to claim 40, further comprising:

a temperature sensor for use at a side end portion on the inner side for detecting a temperature at a side end portion on the inner side of said fixing belt; and a temperature sensor for use at the outer side for detecting a temperature at side end portion on the outer side of said fixing belt, wherein said power supply controller controls power supply to said heating source by comparing detected temperatures by said temperature sensors, said inner-side end-portion temperature sensor, and said outer-side temperature sensor with said preset fixing temperature.

* * * * *